US011391306B2

(12) United States Patent
Toshimori et al.

(10) Patent No.: US 11,391,306 B2
(45) Date of Patent: Jul. 19, 2022

(54) LINEAR ACTUATOR

(71) Applicant: SMC CORPORATION, Tokyo (JP)

(72) Inventors: Yoshihiro Toshimori, Moriya (JP); Toshio Sato, Tsukuba (JP); Atsumi Tsukada, Tsukuba (JP)

(73) Assignee: SMC CORPORATION, Tokyo (JP)

( * ) Notice: Subject to any disclaimer, the term of this patent is extended or adjusted under 35 U.S.C. 154(b) by 0 days.

(21) Appl. No.: 17/179,616

(22) Filed: Feb. 19, 2021

(65) Prior Publication Data

US 2021/0277919 A1 Sep. 9, 2021

(30) Foreign Application Priority Data

Mar. 3, 2020 (JP) ..... JP2020-035823

(51) Int. Cl.
*F15B 15/20* (2006.01)
*F15B 21/00* (2006.01)

(52) U.S. Cl.
CPC ..... *F15B 15/20* (2013.01); *F15B 21/00* (2013.01)

(58) Field of Classification Search
CPC ..... F15B 15/20; F15B 15/1471; F15B 21/00
See application file for complete search history.

(56) References Cited

U.S. PATENT DOCUMENTS 10,189,093 B2 * 1/2019 Saito ..... B23B 31/30
10,323,660 B2 * 6/2019 Ishibashi ..... F15B 15/1471

FOREIGN PATENT DOCUMENTS

JP 3795968 B2 7/2006
JP 2018-151039 A 9/2018
JP 2018151039 A * 9/2018

OTHER PUBLICATIONS

Extended European Search Report dated Jul. 5, 2021 in corresponding European Patent Application No. 21157922.2, 6 pages.

* cited by examiner

*Primary Examiner* — Thomas E Lazo
(74) *Attorney, Agent, or Firm* — Oblon, McClelland, Maier & Neustadt, L.L.P.

(57) ABSTRACT

In a linear actuator, a slide table is attached to a cylinder body via a guide mechanism so as to be movable along the longitudinal direction of the cylinder body. The slide table includes a table body arranged above the cylinder body and extending in the longitudinal direction, and an end plate joined to an end of the table body in the longitudinal direction so as to be substantially orthogonal to the table body. The end plate includes a storage chamber provided on one surface thereof in the longitudinal direction facing a guide mechanism and depressed from the one surface in a direction away from the guide mechanism. For example, when the linear actuator is used in an environment where powder dust and the like is scattered, the storage chamber stores therein a solidified matter made up of the powder dust and the like.

4 Claims, 23 Drawing Sheets

LINEAR ACTUATOR

CROSS-REFERENCE TO RELATED APPLICATION

This application is based upon and claims the benefit of priority from Japanese Patent Application No. 2020-035823 filed on Mar. 3, 2020, the contents all of which are incorporated herein by reference.

BACKGROUND OF THE INVENTION

Field of the Invention

The present invention relates to a linear actuator that reciprocates a slide table along the axial direction of a cylinder body.

Description of the Related Art

Conventionally, as a means for transporting a workpiece or the like, for example, a linear actuator, such as a fluid pressure cylinder, has been used under the action of supplying a pressure fluid. The present applicant has proposed, as disclosed in Japanese Patent No. 3795968, a linear actuator that can transport a workpiece placed on a slide table by reciprocating the slide table linearly along a cylinder body.

SUMMARY OF THE INVENTION

The general object of the present invention is to provide a linear actuator capable of smooth operation by preventing accumulation of dust and dirt in an environment where dust and dirt such as powder dust are scattered.

An aspect of the invention resides in a linear actuator including: a cylinder body containing therein a cylinder chamber to which a pressure fluid is supplied; a slide table configured to be movable along the longitudinal direction of the cylinder body; a cylinder mechanism having a piston arranged in the cylinder chamber and configured to be movable along the cylinder chamber; and a guide mechanism attached to the cylinder body and configured to guide the slide table along the longitudinal direction of the cylinder body under the rolling action of a plurality of rolling elements circulating a passage, the linear actuator being configured to reciprocate the slide table relative to the cylinder body under the moving action of the piston, wherein: the slide table includes a main body extending in the longitudinal direction of the cylinder body, and an end part arranged substantially orthogonal to the main body so as to face an end portion of the cylinder body in the longitudinal direction; and the end part is configured to have a storage portion that is opened on an end surface, of the end part, that faces the cylinder body, the storage portion extending in the longitudinal direction, the storage portion being configured to store dust and dirt therein.

According to the present invention, the slide table of the linear actuator is configured of the main body extending along the longitudinal direction of the cylinder body and the end part arranged substantially orthogonally to the main body so as to face the longitudinal end of the cylinder body. The end part has the storage portion that is opened on an end surface, of the end part, that faces the cylinder body on which the slide table is movably provided, the storage portion extending in the longitudinal direction and being configured to store dust and dirt therein.

Accordingly, even when the linear actuator is used in an environment where powder dust and the like is scattered and, for example, dust (solidified matter) of a mixture of powder dust and a lubricant for lubricating the rolling elements forming the guide mechanism is produced around the longitudinal end of the guide mechanism facing the end part, the produced dust can be suitably collected in the storage chamber when the end part of the slide table is moved to the cylinder body side.

As a result, even when the linear actuator is used in an environment where powder dust and the like is scattered and solidified dust including powder dust and the like builds up, the dust is stored in the storage portion that is opened on the end face of the end part, whereby it is possible to prevent the end part from coming into contact with the accumulated dust when the slide table is being moved, hence the slide table can operate smoothly in the longitudinal direction even under the above environment.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
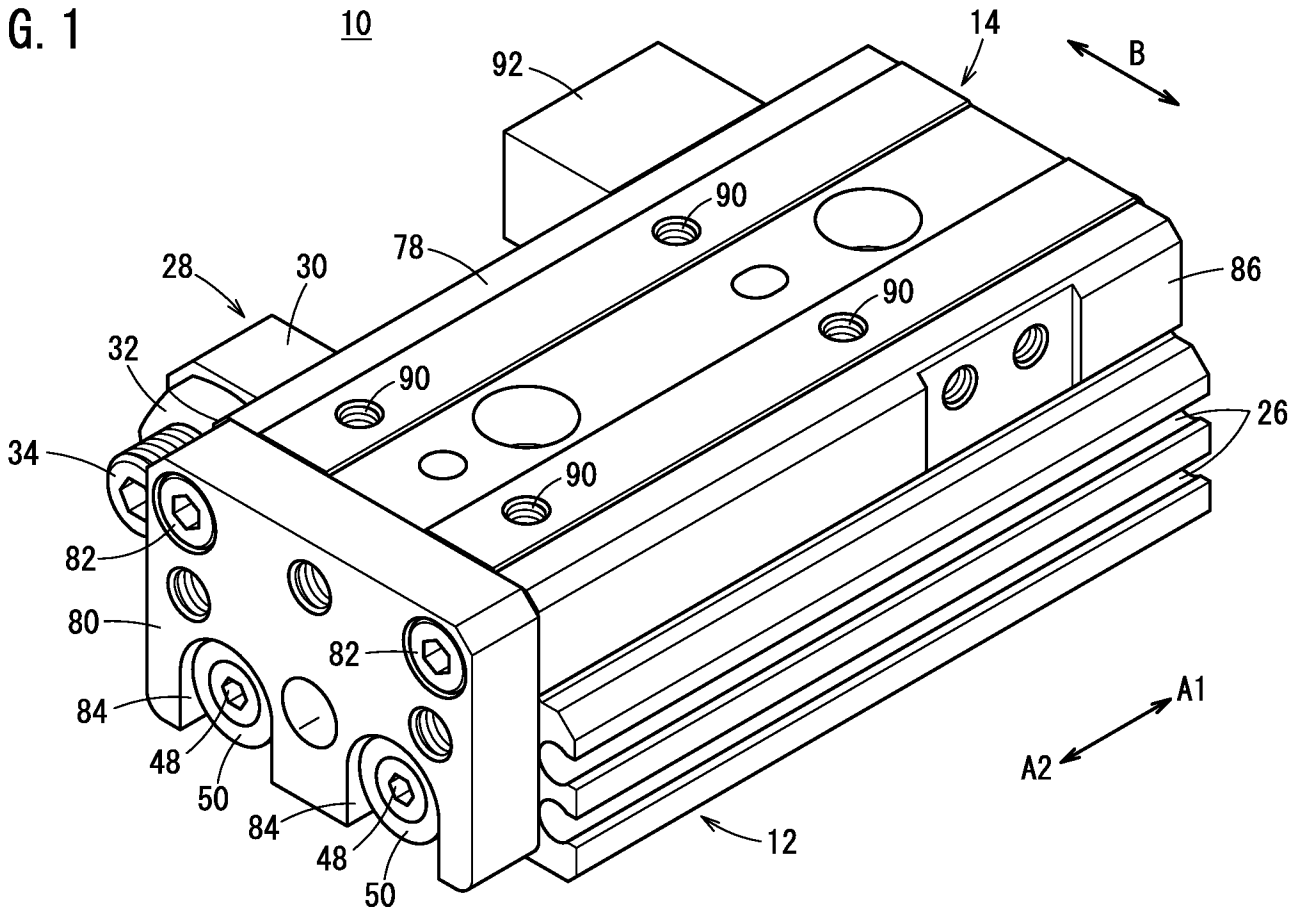
FIG. 1 is an external perspective view of a linear actuator according to the first embodiment of the present invention.

As shown in FIGS. 1 to 6, a linear actuator 10 includes a cylinder body 12, a slide table 14 that reciprocates linearly in the longitudinal direction (indicated by arrows A1 and A2) of the cylinder body 12, and a guide mechanism 18 arranged between the cylinder body 12 and the slide table 14 and held by the cylinder body 12 via a pair of pins 16.

A depressed portion 20 extending in the longitudinal direction (indicated by arrows A1 and A2) is formed on the top face of the cylinder body 12, and a pair of pin insertion holes 22 into which the pins 16 are inserted are formed in the depressed portion 20 so as to be spaced a predetermined distance from each other in the longitudinal direction. Further, the depressed portion 20 includes a pair of attachment holes 24 for attaching the guide mechanism 18 to the cylinder body 12, and the holes 24 are formed so as to penetrate through the depressed portion 20 at positions close to the pin insertion holes 22 (see FIGS. 2 and 3).

The cylinder body 12 includes, on one side surface thereof, two sensor mounting grooves 26 extending along the longitudinal direction (indicated by arrows A1 and A2), and unillustrated sensors are mounted to the mounting grooves 26. Additionally, the cylinder body 12 further includes a stroke adjustor 28, which is provided on the other side surface thereof, which is opposite to the one side surface, and the stroke adjustor 28 limits movement of the slide table 14 by abutment of a stopper block 92, which will be described later.

Figure 2:
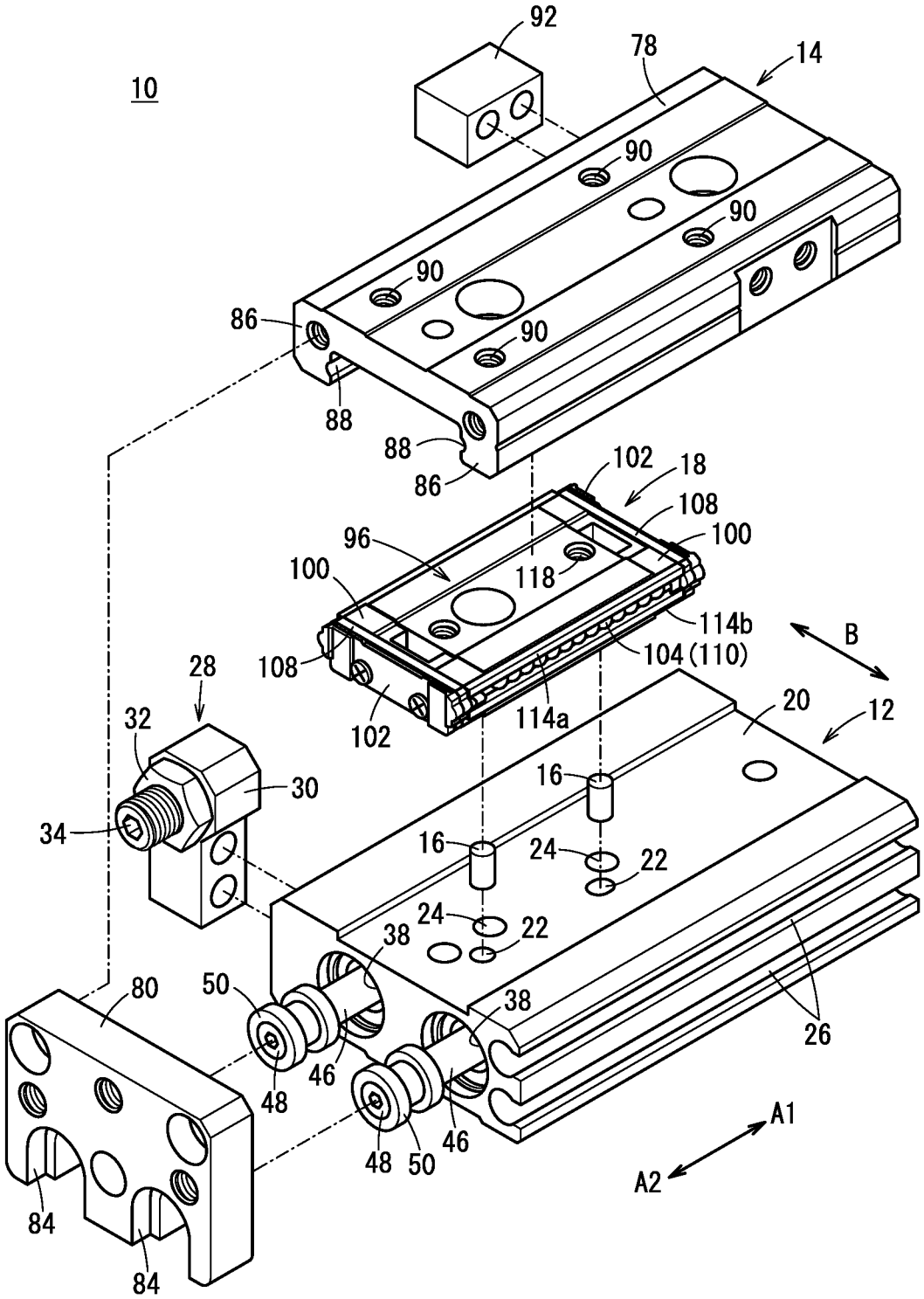
FIG. 2 is an exploded perspective view of the linear actuator shown in FIG. 1.
Figure 3:
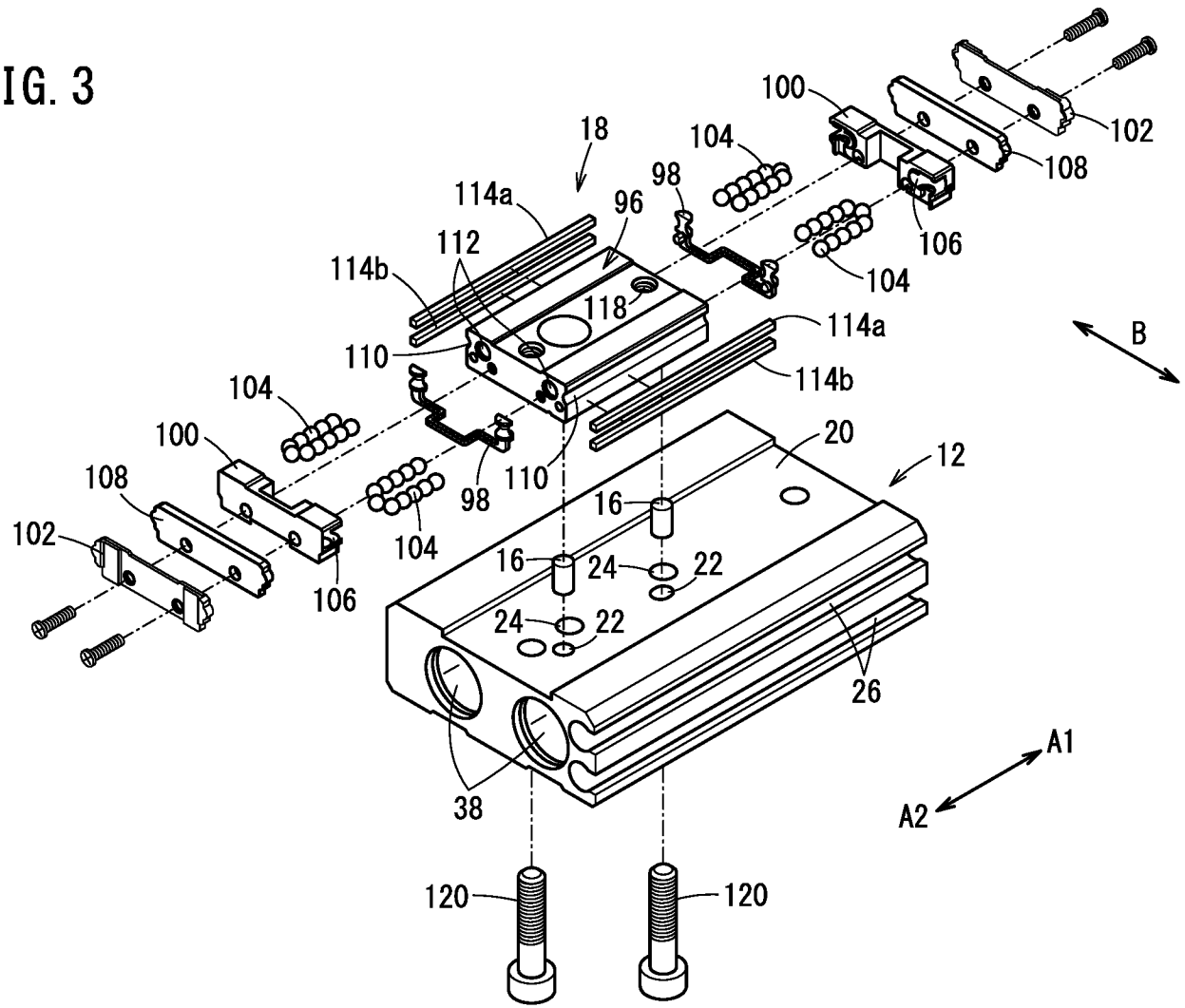
FIG. 3 is an exploded perspective view of a guide mechanism in the linear actuator shown in FIG. 1.
Figure 4:
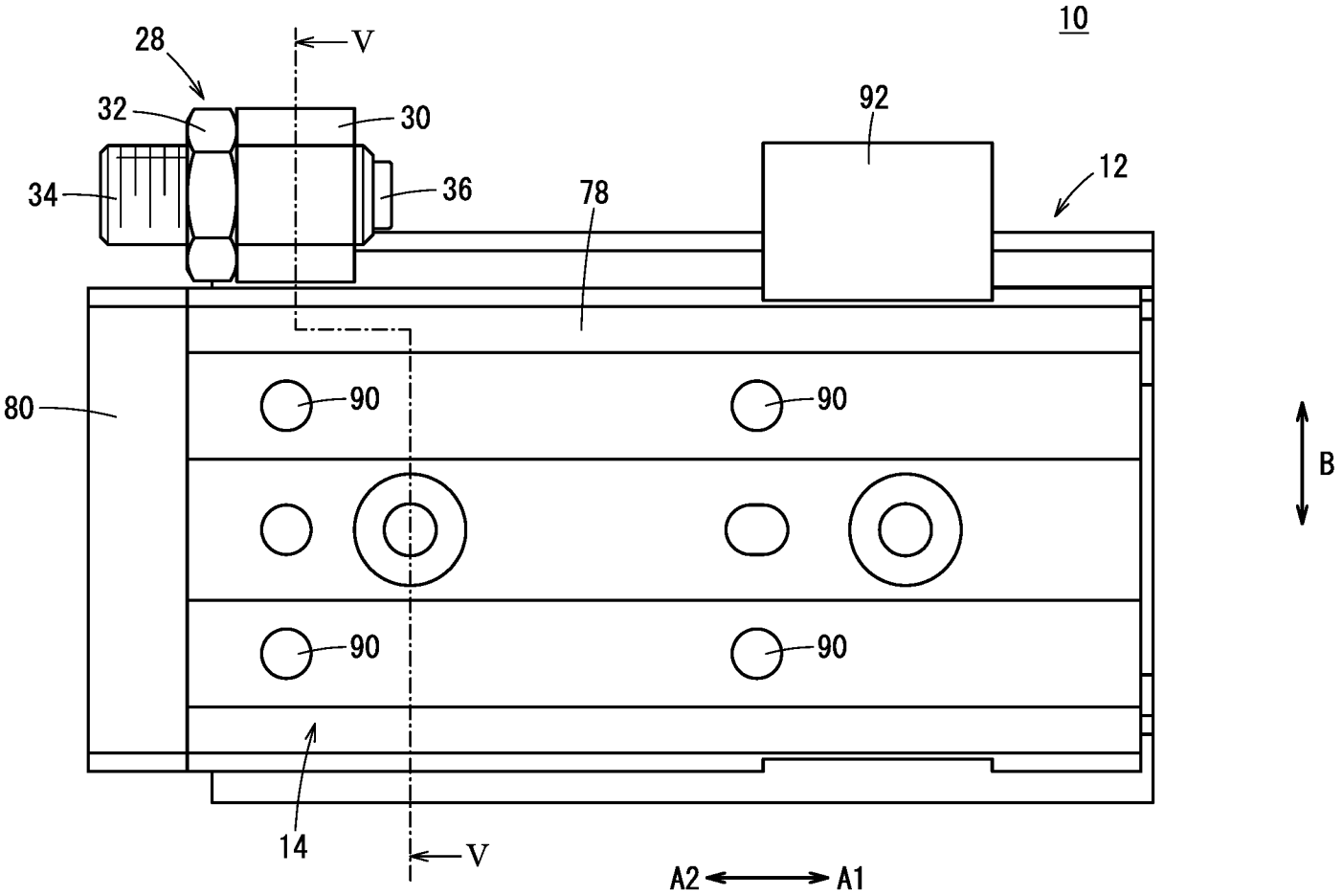
FIG. 4 is an overall plan view of the linear actuator shown in FIG. 1.

As shown in FIGS. 1, 2 and 4, the stroke adjustor 28 includes a block body 30, a stud bolt 34 screwed into the holes of the block body 30 and fixed to the block body 30 via a nut 32, and a damper member 36 mounted at one longitudinal end of the stud bolt 34. Then, in the stroke adjustor 28, the stud bolt 34 is turned with respect to the block body 30 to advance or retreat in the longitudinal direction (in the direction of arrow A1 or A2), so as to adjust the amount of movement of the slide table 14 in the longitudinal direction.

Also, inside the cylinder body 12, as shown in FIGS. 2, 3, 5 and 6, a pair of through holes 38 extending in the longitudinal direction (indicated by arrows A1 and A2) are formed. The through holes 38 have a circular cross section with substantially the same diameter. The through holes 38 are spaced from each other in the width direction (indicated by arrow B direction) that is orthogonal to the longitudinal direction, so as to extend in parallel with each other.

Figure 6:
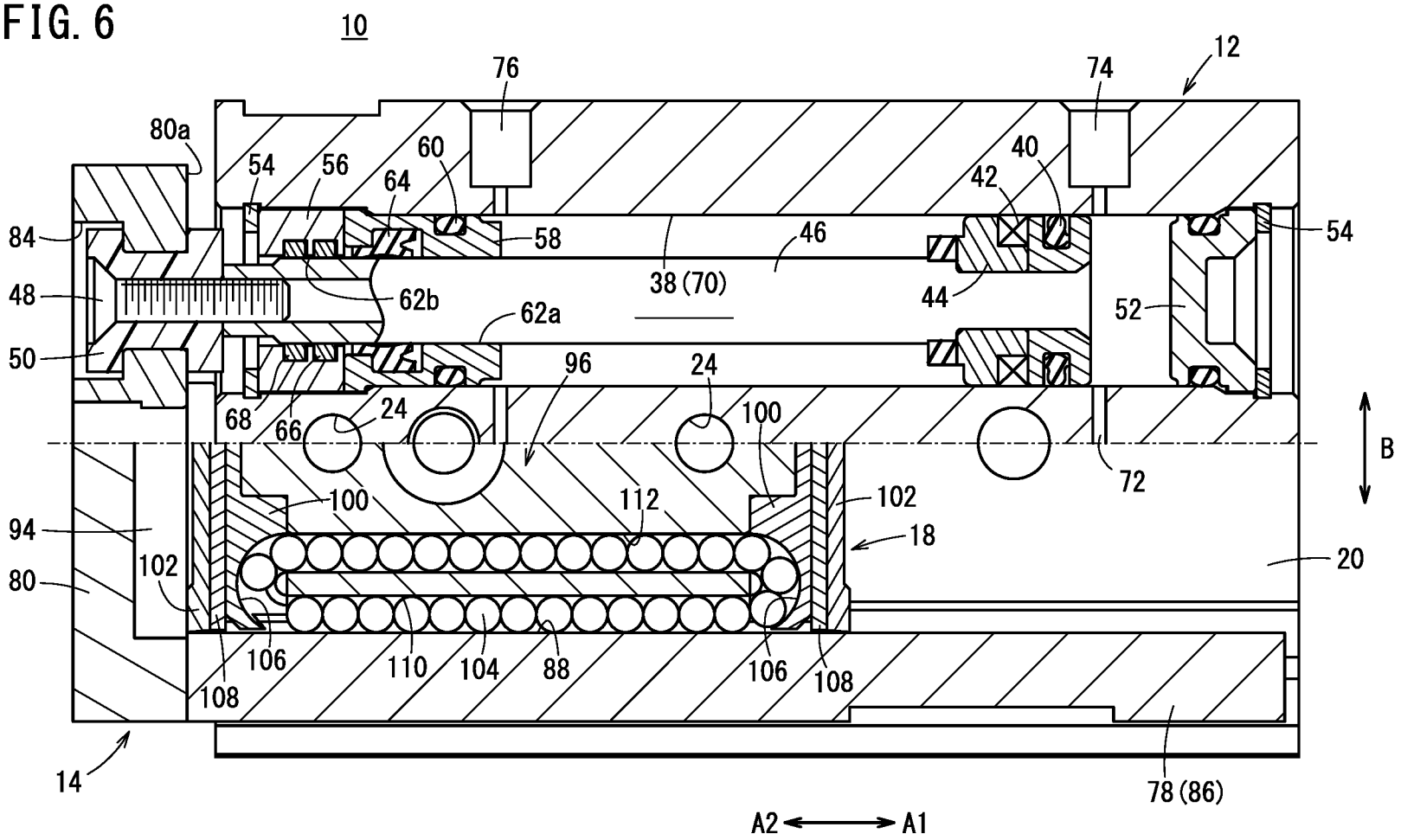
FIG. 6 is a sectional view taken along a VI-VI line of FIG. 5.
Figure 7:
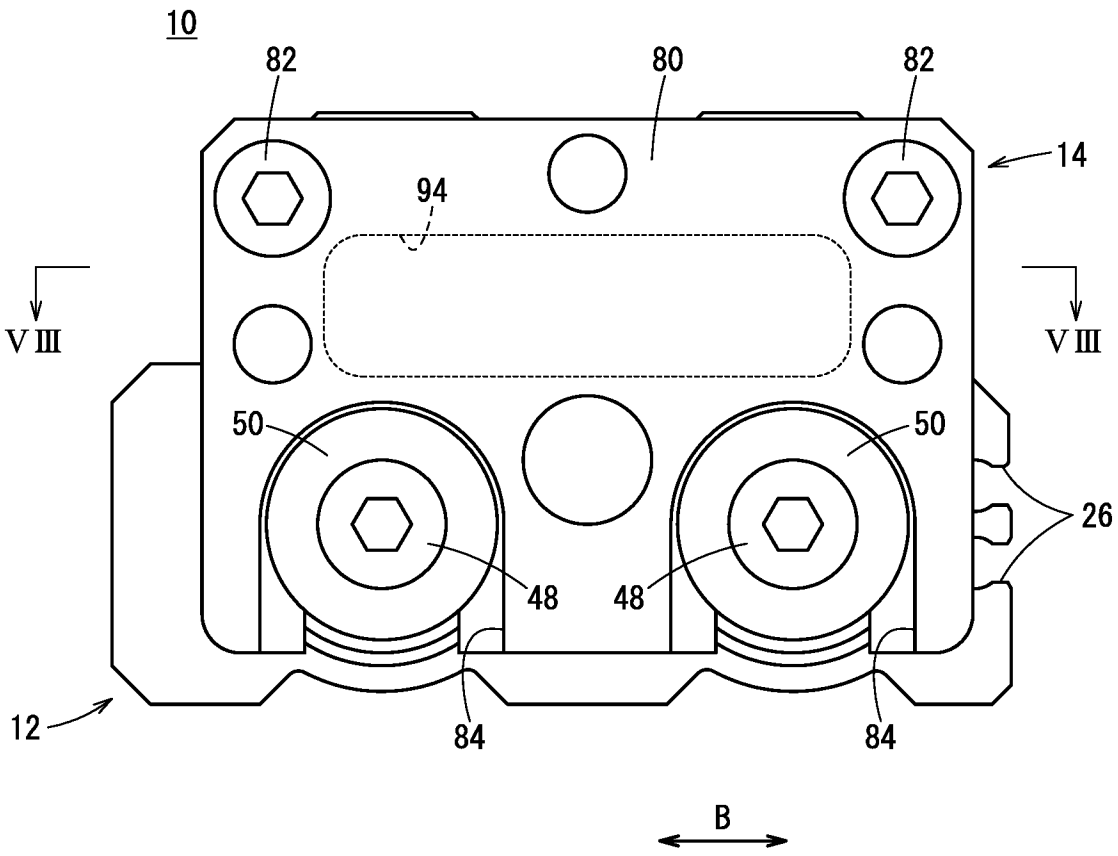
FIG. 7 is a front view of the linear actuator shown in FIG. 1 as viewed from the end plate side.

As shown in FIG. 6, each through hole 38 contains thereinside a piston 44 having a piston packing 40 and a magnetic body 42 mounted on the outer peripheral surface thereof and a piston rod 46 connected to the piston 44. A floating bush 50 is coupled to the opposite longitudinal end of the piston rod 46 by a screw member 48.

Further, each through hole 38 is closed at one longitudinal end (which will be referred to as the first longitudinal end) by an end cap 52 that is inserted into the hole and locked by a snap ring 54. Also, a ring body 56 and a collar member 58 are inserted into the through hole 38 at the other longitudinal end (which will be referred to as the second longitudinal end) and locked by the snap ring 54 in the longitudinal direction, so as to close the through hole 38.

An O-ring 60 is mounted into an annular groove of the outer peripheral surface of the collar member 58 so as to abut against the inner peripheral surface of the through hole 38 while a rod hole 62*a* penetrates through the center of the collar member 58 so as to allow the piston rod 46 to be inserted along the longitudinal direction. A rod packing 64 is mounted into an annular groove of the inner peripheral surface of the collar member. This rod packing 64 is made of an elastic material, and is in sliding contact with the outer peripheral surface of the piston rod 46 to thereby establish sealing.

On the other hand, the ring body 56 is provided on the second longitudinal end side (on the arrow A2 side) of the collar member 58. The ring body 56 includes therein a rod hole 62*b* penetrating therethrough in the longitudinal direction, and the piston rod 46 is inserted into the rod hole 62*b*. A lubrication ring 66 and a dustproof ring 68 are provided in respective annular grooves of the inner peripheral surface of the rod hole 62*b*. The dustproof ring 68 is arranged so as to be on the second longitudinal end side (the arrow A2 side) of the through hole 38, whereas the lubrication ring 66 is arranged on the first longitudinal end side (the arrow A1 side) of the dustproof ring 68.

The lubrication ring 66 is formed in an annular shape and made of a flexible and compressible material impregnated with a lubricant such as grease. The lubrication ring 66 is put in sliding contact with the outer peripheral surface of the piston rod 46. Similarly to the lubrication ring 66, the dustproof ring 68 is formed in an annular shape and made of a flexible and compressible material. The dustproof ring 68 is not impregnated with a lubricant and is used in a dry state.

Further, by closing the first and second ends of each through hole 38 with the end cap 52 and the collar member 58, respectively, a pair of cylinder chambers 70 accommodating the piston 44 and the piston rod 46 are configured. One cylinder chamber 70 and the other cylinder chamber 70 are connected to (i.e., communicate with) each other via a pair of communication passages 72 extending in the width direction (in the direction of arrow B).

Further, a pair of first and second fluid ports 74, 76 are formed on the second end side surface of the cylinder body 12, and the first and second fluid ports 74, 76 are each connected to communicate with one of the cylinder chambers 70. The first fluid port 74 is arranged on the first longitudinal end side of the cylinder body 12 (on the arrow A1 side), and the second fluid port 76 is arranged on the second longitudinal end side of the cylinder body 12 (on the arrow A2 side).

That is, the piston 44 and the piston rod 46 described above function as a cylinder mechanism that can be moved in the longitudinal direction by the supplying action of the pressure fluid to the cylinder chamber 70.

As shown in FIGS. 1 to 8, the slide table 14 is formed of a table body (main body) 78 extending in the longitudinal direction (indicated by arrows A1 and A2) and an end plate (end part) 80 fixed to the second longitudinal end of the table body 78 so as to be orthogonal to the longitudinal direction of the table body. The table body 78 and the end plate 80 are fastened to each other using a pair of bolts 82 in such a state that they are orthogonal to each other forming a substantially L-shaped cross section. That is, the end plate 80 is formed so as to extend in the vertical direction with respect to the table body 78 extending in the horizontal direction.

The table body 78 is formed in a substantially U-shaped cross section, having a pair of guide portions 86 protruding toward the cylinder body 12 (downward) from both ends in the width direction thereof. The guide portions 86 are formed to extend in the longitudinal direction (in the direction of arrows A1 and A2), and have respective ball rolling grooves 88 extending in the longitudinal direction on the respective inner wall surfaces of the guide portions 86 facing each other (see FIGS. 5 and 6). Further, four workpiece holding holes 90 are formed in the top surface of the table body 78. Here, the number of workpiece holding holes 90 is not limited to four, and is appropriately set according to the stroke amount of the slide table 14, for example.

Further, a stopper block 92 is fixed to one side surface of the table body 78 so as to project in the width direction of the table body, so that the stopper block 92 moves integrally with the slide table 14 and faces toward the stroke adjustor 28 provided on the cylinder body 12. When the slide table 14 including the table body 78 moves in the longitudinal direction relative to the cylinder body 12, the stopper block 92 comes into contact with the damper member 36 of the stroke adjustor 28, so that the movement of the slide table 14 in the longitudinal direction is restricted.

Figure 8:
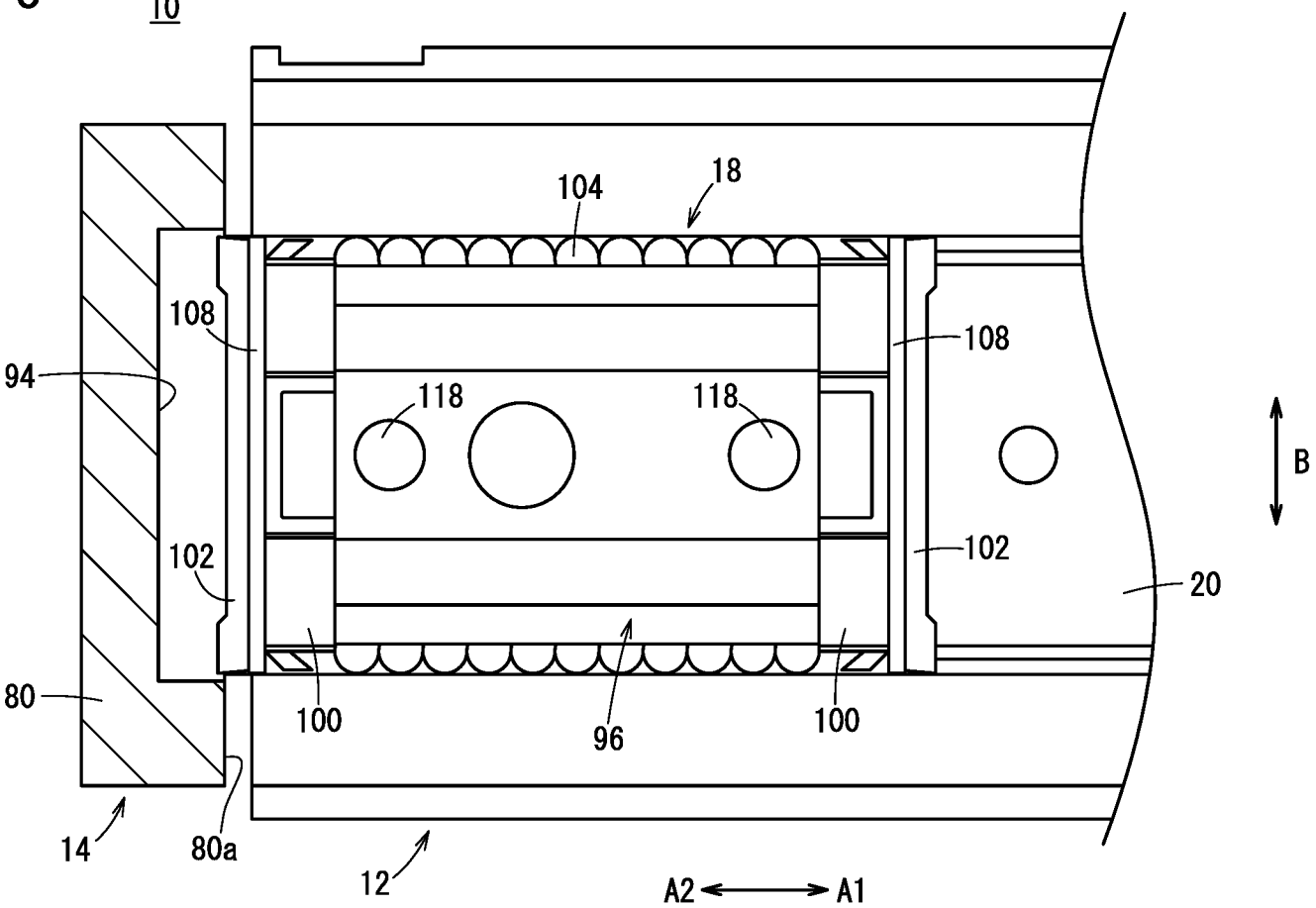
FIG. 8 is a partial sectional plan view taken along a line VIII-VIII in FIG. 7.

The end plate 80 is a plate member having a rectangular cross section elongated in the width direction of the slide table (in the direction of arrow B) and a constant thickness in the longitudinal direction of the slide table. Floating bushes 50 are held by substantially semicircular holes 84 formed in the lower part of the end plate. Further, as shown in FIGS. 6 and 8, the end plate 80 includes a storage chamber (storage portion) 94 having a predetermined volume, which is formed in an surface (one end surface in the longitudinal direction) 80*a* of the end plate 80 that faces toward the table body 78 (the arrow A1 direction).

This storage chamber 94 is formed with a hollow having a predetermined depth, formed by recessing the end surface 80*a* of the end plate 80 in the direction away from the table body 78 (in the direction of arrow A2), and the storage chamber 94 is formed in a position facing the guide mechanism 18. That is, the storage chamber 94 is at least formed such that its width (the length in the direction of arrow B) is equal to or greater than the width of the guide block 96 while its height is equal to or greater than the height of the guide block 96.

The width and height of the storage chamber 94 are not limited to the cases corresponding to the width and height of the guide block 96 of the guide mechanism 18 as described above, and may have any sizes as long as the storage chamber 94 is formed in a larger shape than the sectional shape of the guide block 96 when viewed from the longitudinal direction.

As shown in FIGS. 2, 3, 5, and 6, the guide mechanism 18 includes a guide block 96 which is flattened in the width direction (the direction of arrow B), a set of ball return members 98, cover blocks 100 and scrapers 102, which are arranged on both longitudinal ends of the guide block 96, and a pair of pins 16 for positioning and holding the guide block 96 with respect to the cylinder body 12. The cover block 100 is formed with semicircular ball return grooves 106 that each circulate bearing balls (rolling elements of a ball bearing) 104 in cooperation with the ball return members 98.

Further, a first dustproof plate 108 is held between the cover block 100 and the scraper 102. The first dustproof plate 108 is formed into a plate shape and made of, for example, a flexible and compressible material. The first dustproof plate 108 is provided such that its upper surface is in sliding contact with the inner surface of the table body 78 of the slide table 14 and its both ends in the width direction (the direction of arrow B) is in sliding contact with the guide portions 86 of the slide table 14. Further, the scraper 102 is arranged so as to have a slight clearance with respect to the ball rolling grooves 88 or so as to be in sliding contact with the ball rolling grooves 88, so that powder dust and the like are prevented from entering the guide mechanism 18.

Additionally, a pair of ball rolling grooves 110 extending in the longitudinal direction (the direction of arrows A1 and A2) are formed on both sides of the guide block 96 in the width direction while a pair of ball circulating holes 112 that penetrate through the guide block 96 in the longitudinal direction are formed on an inner side, in the width direction, than the respective ball rolling grooves 110 so as to be spaced a predetermined interval from each other. Thus, the ball rolling groove 88 of the guide portion 86 in the slide table 14, the ball rolling groove 110 in the guide block 96, the ball circulating hole 112, and the ball return groove 106 of the cover block 100 constitute a ball circulation passage that enables circulation of bearing balls 104.

Further, on each of both side surfaces of the guide block 96, a pair of second dustproof plates 114*a*, 114*b* are provided respectively at top and bottom of the ball rolling groove 110. The second dustproof plates 114*a*, 114*b* are formed of, for example, a flexible and compressible material elongated in a in the longitudinal direction of the guide block. The second dustproof plates 114*a*, 114*b* are fixed to each of both side surfaces of the guide block 96 so as to be sliding contact with the guide portions 86 of the slide table 14.

In the thus configured guide mechanism 18, the multiple bearing balls 104 roll along the ball circulation passage, so that the slide table 14 provided so as to cover the guide mechanism 18 is supported so as to reciprocate in the longitudinal direction (the direction of arrows A1 and A2) relative to the guide block 96. Further, since the second dustproof plates 114*a* and 114*b* are in sliding contact with the guide portion 86 of the slide table 14, the dust and dirt that have entered in between the guide portion 86 and the guide block 96 are prevented from entering the ball rolling grooves 88 and 110.

Figure 5:
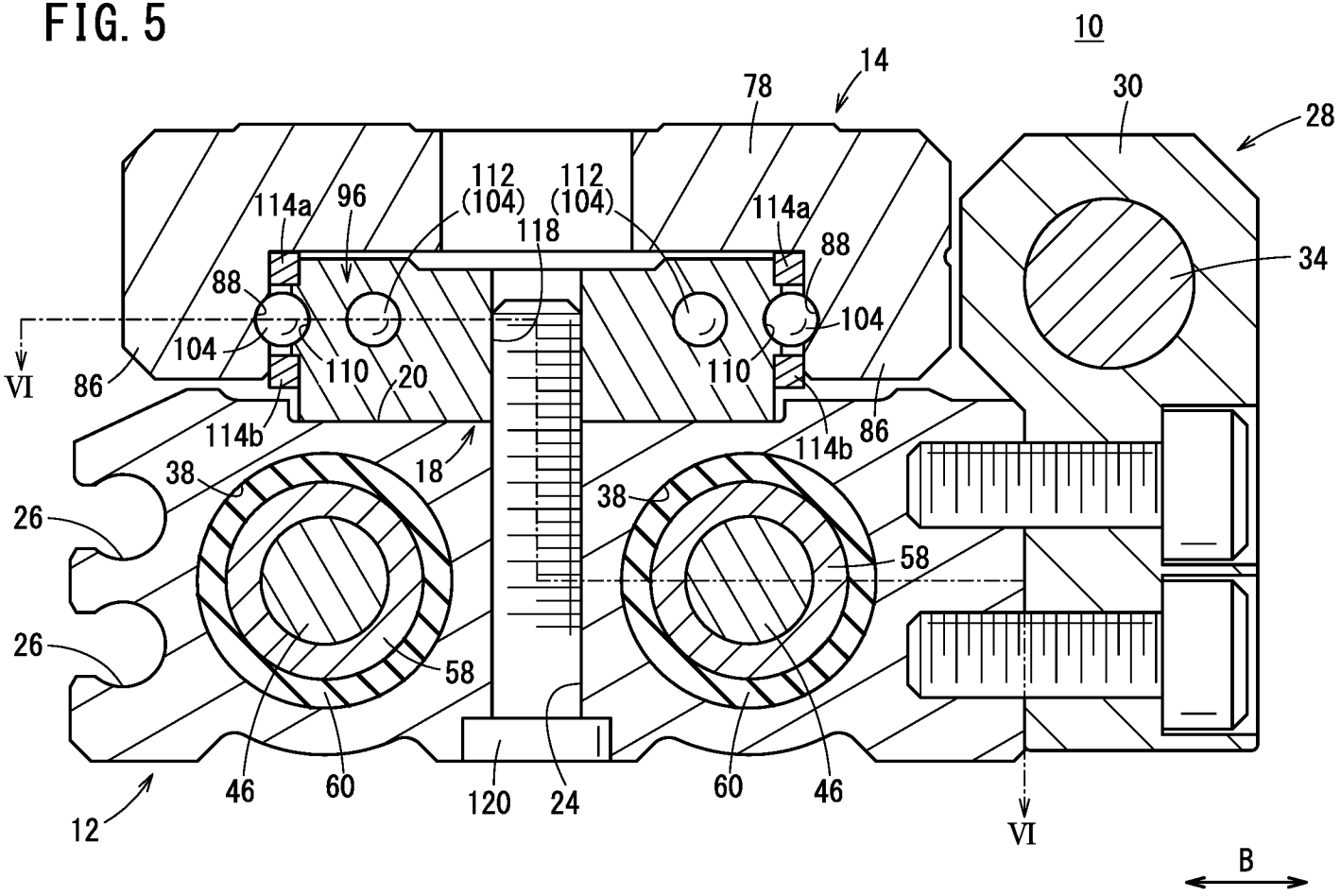
FIG. 5 is a sectional view taken along a V-V line in FIG. 4.

Further, the guide block 96 has, formed on a bottom surface thereof, pin insertion holes (not shown) for receiving a pair of pins 16, the pin insertion holes being arranged at a predetermined interval. The guide block 96 also has a pair of threaded fixing bolt holes 118 formed at portions close to the pin insertion holes, and the bolt holes 118 penetrate through the guide block 96 (see FIG. 5). In this arrangement, as shown in FIG. 5, fixing bolts 120 are inserted from below into the attachment holes 24 of the cylinder body 12, and screw-engaged into the fixing bolt holes 118 of the guide block 96, whereby the guide mechanism 18 including the guide block 96 is fixed to the top surface (depressed portion 20) of the cylinder body 12.

The linear actuator 10 according to the first embodiment of the present invention is essentially configured as described above, and its operation, action and effect will be described next. Herein, a state in which the piston 44 shown in FIG. 6 is located on the first longitudinal end side (on the arrow A1 side) will be referred to as the initial position.

First, the pressure fluid is supplied to the first fluid port 74 from an unillustrated fluid pressure supply source while the second fluid port 76 is opened to the atmosphere by a switching operation of an unillustrated switching device.

Since the pressure fluid from the first fluid port 74 is also supplied from one cylinder chamber 70 to the other cylinder chamber 70 through the communication passages 72, the paired pistons 44 are pushed toward the second longitudinal end (in the direction of arrow A2), and the pistons 44 together with the piston rods 46 move to the second longitudinal end side. The floating bushes 50 coupled with the piston rods 46 press the end plate 80 to the second longitudinal end side (in the direction of arrow A2). As a result, the slide table 14 including the end plate 80 moves to the second longitudinal end side (in the direction of arrow A2) relative to the guide mechanism 18 under the rolling action of the bearing balls 104 circulating along the ball circulation passage.

In the process of moving the slide table 14, the stopper block 92 comes into contact with the damper member 36 of the stroke adjustor 28, so that further movement in the longitudinal direction is restricted and the movement ends at that point (i.e., end position).

On the other hand, when the slide table 14 is moved to the first longitudinal end side (in the direction of arrow A1) opposite to the above, the pressure fluid is supplied to the second fluid port 76 while the first fluid port 74 is opened to the atmosphere. In this state, the pistons 44 are pressed and moved to the first longitudinal end side (in the direction of arrow A1) by the pressure fluid supplied to the cylinder chamber 70. With the movement of the pistons 44, the end plate 80 and the slide table 14 move to the first longitudinal end side (in the direction of arrow A1), and the end plate 80 comes into contact with the second longitudinal end of the slide table 14, and returns to the initial position shown in FIG. 1.

Next, description will be given concerning a case where the above-described linear actuator 10 is used in an environment where powder dust and the like is scattered in the atmosphere.

In this environment, when powder dust and the like scattered in the atmosphere adhere to the surfaces of the cylinder body 12 and the slide table 14 of the linear actuator 10 while the linear actuator 10 is driven, the powder dust and the like also adhere to the surface of the piston rods 46 exposed to the outside from the through holes 38 of the cylinder body 12.

The powder dust and the like thus adhering to the piston rods 46 are suitably scraped off by the dustproof rings 68 arranged on the outermost side during the pulling operation of the piston rods 46 into the cylinder body 12, so that entry of the dust and the like into the cylinder chamber 70 can be reliably prevented.

Further, lubricant is supplied to the outer peripheral surface of the piston rod 46 by the lubrication ring 66 provided on an inner side than the dustproof ring 68 (on the arrow A1 side), and as a result, the piston rod 46 can be smoothly moved along the longitudinal direction. In addition, the dustproof ring 68 suitably prevents leakage of the lubricant applied to the piston rod 46 to the outside (to the arrow A2 side).

Further, the first dustproof plate 108 provided on the guide mechanism 18 is in sliding contact with the inner surface of each of the guide portions 86 in the slide table 14, so that it is possible to prevent the powder dust and the like entering in between the second longitudinal end of the guide block 96 and the end plate 80 of the slide table 14, from entering the ball return groove 106 and the ball rolling grooves 88, 110. Additionally, the upper surface of the first dustproof plate 108 is in sliding contact with the undersurface of the table body 78, so that it is possible to prevent the powder dust and the like adhering to the undersurface from entering the guide mechanism 18. Further, the scraper 102 is provided such that a slight gap is formed between the scraper 102 and the ball rolling groove 88, or such that the scraper 102 is in sliding contact with the ball rolling groove 88, so that it is possible to prevent powder dust and the like from entering the guide mechanism 18.

Furthermore, the second dustproof plates 114*a* and 114*b* provided on respective both side surfaces of the guide mechanism 18 prevent powder dust and the like from entering the ball rolling grooves 88 and 110 from the first end and the second end in the longitudinal direction of the guide portion 86. At the same time, powder dust and the like are prevented from invading the ball rolling grooves 88 and 110 from the slide table 14 side and the lower side of the cylinder body 12. Therefore, adhesion of powder dust and the like to the bearing balls 104 is reliably prevented.

Moreover, in the ball circulation passage formed by the guide mechanism 18 and the slide table 14, multiple bearing balls 104 circulate in a state of being lubricated with a lubricant such as grease, and the lubricant and powder dust and the like, for example, mingle together and may solidify into a solidified matter of dust. Detailedly, the solidified matter may be produced around the widthwise ends of the guide block 96 that hold the bearing balls 104 in a circulatory manner and face the guide portions 86.

Since the end plate 80 has the storage chamber 94 that is opened on the end surface 80*a*, of the end plate 80, on the first longitudinal end side and faces the second longitudinal end of the guide block 96, when the slide table 14 is moved to the first longitudinal end side (to the arrow A1 side) relative to the cylinder body 12 in the case where the solidified matter has arisen in the above way, the solidified matter generated around the second longitudinal end can be appropriately pushed into the storage chamber 94. Therefore, when the slide table 14 is moved to the first longitudinal end side (in the direction of arrow A1), the solidified matter adhering to and accumulated on the guide block 96 is prevented from coming into contact with the end surface 80*a* on the first longitudinal end side of the end plate 80, and hence it is possible to prevent longitudinal movement of the slide table 14 from being hindered.

That is, even when the linear actuator 10 is used in an environment where powder dust and the like are scattered, solidified matter, for example, generated near the second longitudinal end of the guide mechanism 18 can be stored in the storage chamber 94.

As described above, in the first embodiment, the slide table 14 of the linear actuator 10 includes the table body 78 provided above and parallel to the cylinder body 12, and the end plate 80 joined to the second longitudinal end of the table body 78 so as to be orthogonal to the longitudinal direction of the table body 78. The end plate 80 has the storage chamber 94 that is opened so as to face the guide mechanism 18 fixed to the cylinder body 12 and is depressed in the direction (in the direction of arrow A2) away from the guide mechanism 18.

Therefore, even if the linear actuator 10 is used in an environment where powder dust and the like are scattered, and for example, the lubricant for lubricating the bearing balls 104 in the guide mechanism 18 is mingled with the powder dust and the like to thereby generate a solidified matter, it is possible to aptly store, in the storage chamber 94, the solidified matter adhering to and accumulated around the guide mechanism 18 when the end plate 80 of slide table 14 moves to the guide mechanism 18 side (in the direction of arrow A1).

As a result, even when the linear actuator 10 is used in an environment where powder dust and the like are scattered and resultantly a solidified matter is generated, the solidified matter adhering to the vicinity of the second longitudinal end of the guide mechanism 18 is stored inside the storage chamber 94, whereby it is possible to avoid a situation where the end plate 80 comes into contact with the solidified matter to consequently hinder operation of the end plate 80 under the moving action of the slide table 14. Thus, even in the above environment, the slide table 14 constituting the linear actuator 10 can be smoothly operated along the longitudinal direction.

Further, since the storage chamber 94 is formed to have substantially the same cross-sectional shape as, or a cross-sectional shape larger than, that of the guide mechanism 18 when viewed from the longitudinal direction of the linear actuator 10, the solidified matter generated near the second longitudinal end of the guide mechanism 18 can be reliably stored inside the storage chamber 94.

Further, by appropriately setting the depth of the storage chamber 94 along the longitudinal direction, it is possible to adjust the volume for the solidified matter to be stored, as desired.

Furthermore, since the first dustproof plate 108 is provided in the second longitudinal end of the guide mechanism 18, it is possible to prevent the powder dust and the like that has entered in between the guide block 96 and the end plate 80 of the slide table 14, from entering the ball return grooves 106 and the ball rolling grooves 88 and 110. Also, sliding contact of the first dustproof plate 108 with the undersurface of the table body 78 can prevent powder dust and the like adhering to the undersurface from invading the guide mechanism 18 side.

Further, in the guide mechanism 18, a pair of second dustproof plates 114*a* and 114*b* are provided on each of the side surfaces in the width direction. Therefore, the second dustproof plates 114*a* and 114*b* prevent powder dust and the like from entering the ball rolling grooves 88 and 110 from the first and second longitudinal ends of the guide block 96, and also from the slide table 14 side and the lower side of the cylinder body 12. As a result, it is possible to reliably prevent powder dust and the like from entering in between the slide table 14 and the guide mechanism 18 and adhering to the bearing balls 104, thus preventing operation failures of the linear actuator 10 due to invasion of powder dust and the like.

Further, in the cylinder body 12, provision of the annular dustproof ring 68 in the rod hole 62*b* of the ring body 56 makes it possible to reliably scrape off the powder dust and the like adhering to the outer peripheral surface of the piston rod 46 exposed to the outside of the cylinder body 12 when the piston rod 46 is pulled in, and hence prevent entry of the dust and the like into the cylinder chamber 70.

Figure 9:
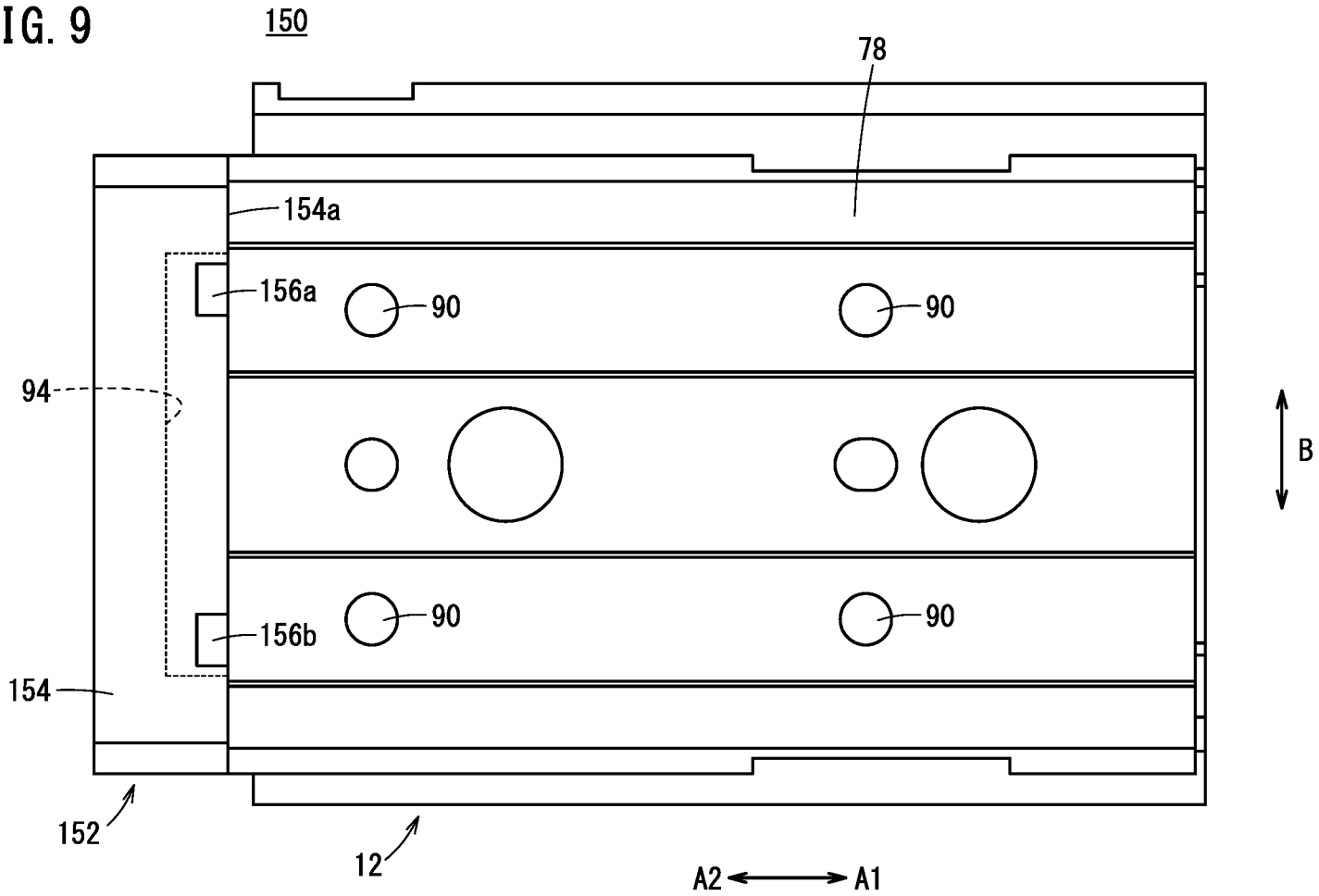
FIG. 9 is a plan view of a linear actuator according to a second embodiment of the present invention.
Figure 10:
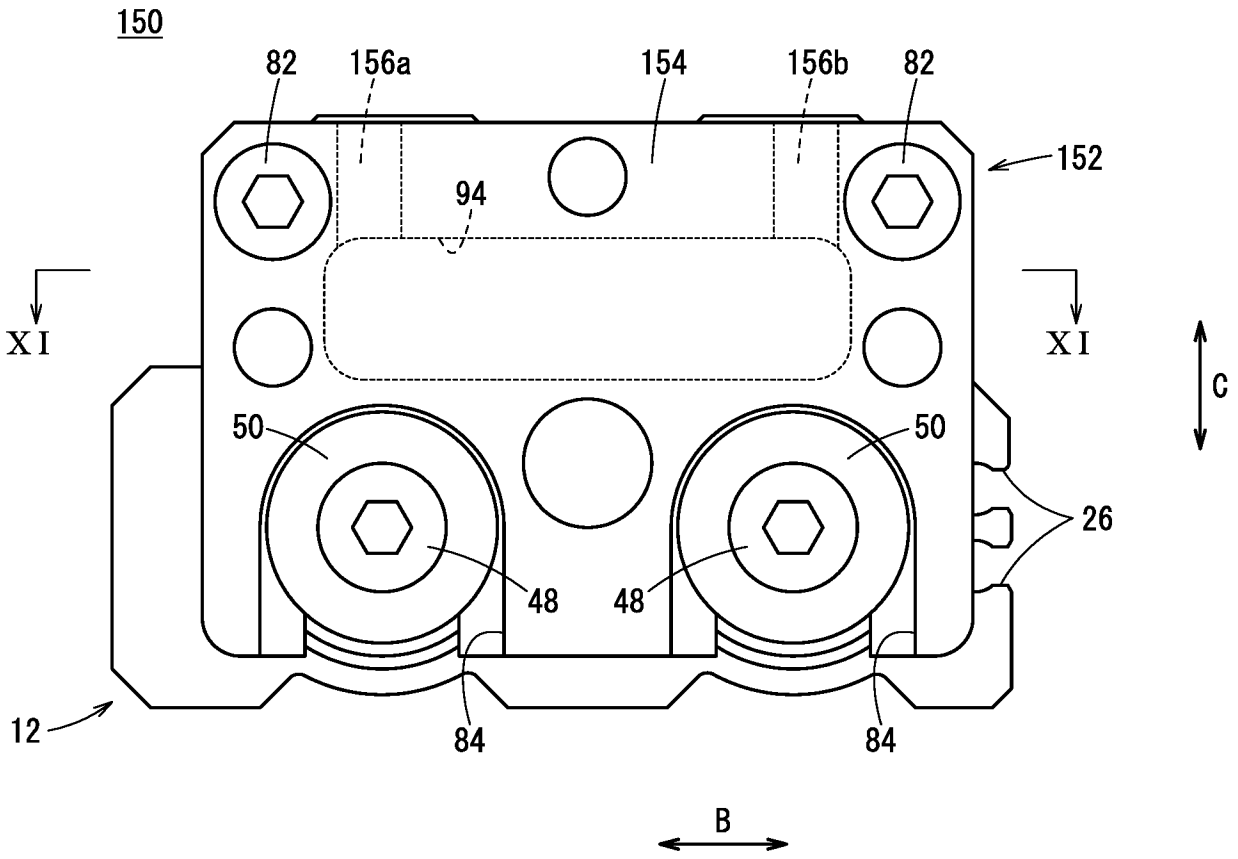
FIG. 10 is a front view of the linear actuator shown in FIG. 9 as viewed from the end plate side.
Figure 11:
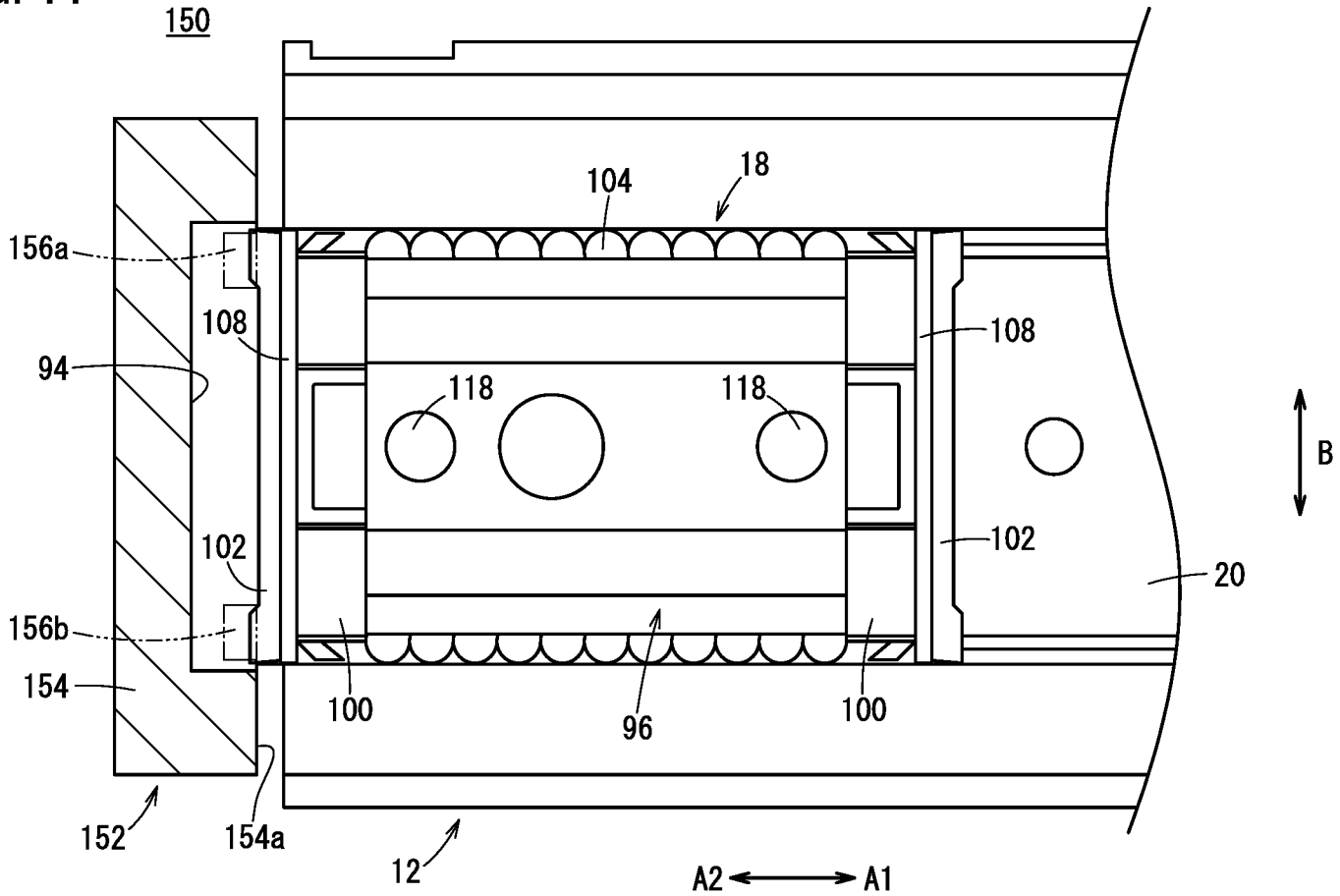
FIG. 11 is a partial sectional plan view taken along a XI-XI line in FIG. 10.

Next, a linear actuator 150 according to the second embodiment is shown in FIGS. 9 to 11. The same components as those of the linear actuator 10 according to the first embodiment described above are allotted with the same reference numerals, and detailed description thereof will be omitted.

The linear actuator 150 according to the second embodiment is different from the linear actuator 10 according to the first embodiment in that a pair of work holes 156*a* and 156*b* opened upward of an end plate 154 in the slide table 152 are provided.

As shown in FIGS. 9 to 11, the linear actuator 150 is formed with a pair of work holes 156*a* and 156*b* formed in the end plate 154 of the slide table 152 so as to extend in the height direction (in the direction of arrow C).

The work holes 156*a* and 156*b* are formed in the end plate 154 connected to the table body 78, for example, on an end surface 154*a* facing the second longitudinal end, and the work holes are spaced a predetermined interval from each other in the width direction (the direction of arrow B). Each of the work holes 156*a* and 156*b* is formed so as to have a rectangular cross section and penetrate in a straight line from the upper surface of the end plate 154 to the storage chamber 94 formed inside. That is, in the slide table 152, the storage chamber 94 communicates with the outside through a pair of work holes 156*a* and 156*b*. The numbers, positions, etc. of the work holes 156*a* and 156*b* are not limited to the above-described configuration, and may be appropriately adapted as necessary.

When the linear actuator 150 described above is used in an environment where powder dust and the like is scattered, and for example, a solidified matter formed of a mixture of the powder dust and the like and the lubricant for lubricating the bearing balls 104 in the guide mechanism 18 is stored in the storage chamber 94, an unillustrated operator jets compressed air into the interior through the pair of work holes 156*a* and 156*b*. Thus, the interior of the storage chamber 94 is pressurized under the supplying action of the compressed air, so that the accumulated solidified matter can be discharged to the outside from the opening of the storage chamber 94 on the end surface 154*a* facing the second longitudinal end. Instead of using compressed air, it is also possible to insert a rod-shaped member into the work holes 156*a* and 156*b* to push out the solidified matter accumulated in the storage chamber 94.

Therefore, the solidified matter stored in the storage chamber 94 can be readily and reliably discharged to the outside through the work holes 156*a* and 156*b* without removing or moving the slide table 152, thereby improving the maintainability.

Next, a linear actuator 160 according to the third embodiment is shown in FIGS. 12 to 17. The same components as those of the linear actuator 10 according to the first embodiment described above are allotted with the same reference numerals, and detailed description thereof will be omitted.

The linear actuator 160 according to the third embodiment is different from the linear actuator 10 according to the first embodiment in that a storage chamber (storage portion) 166 formed in an end plate 164 of a slide table 162 is formed to penetrate through the end plate in the thickness direction (lengthwise direction, the direction of arrows A1 and A2).

Figure 12:
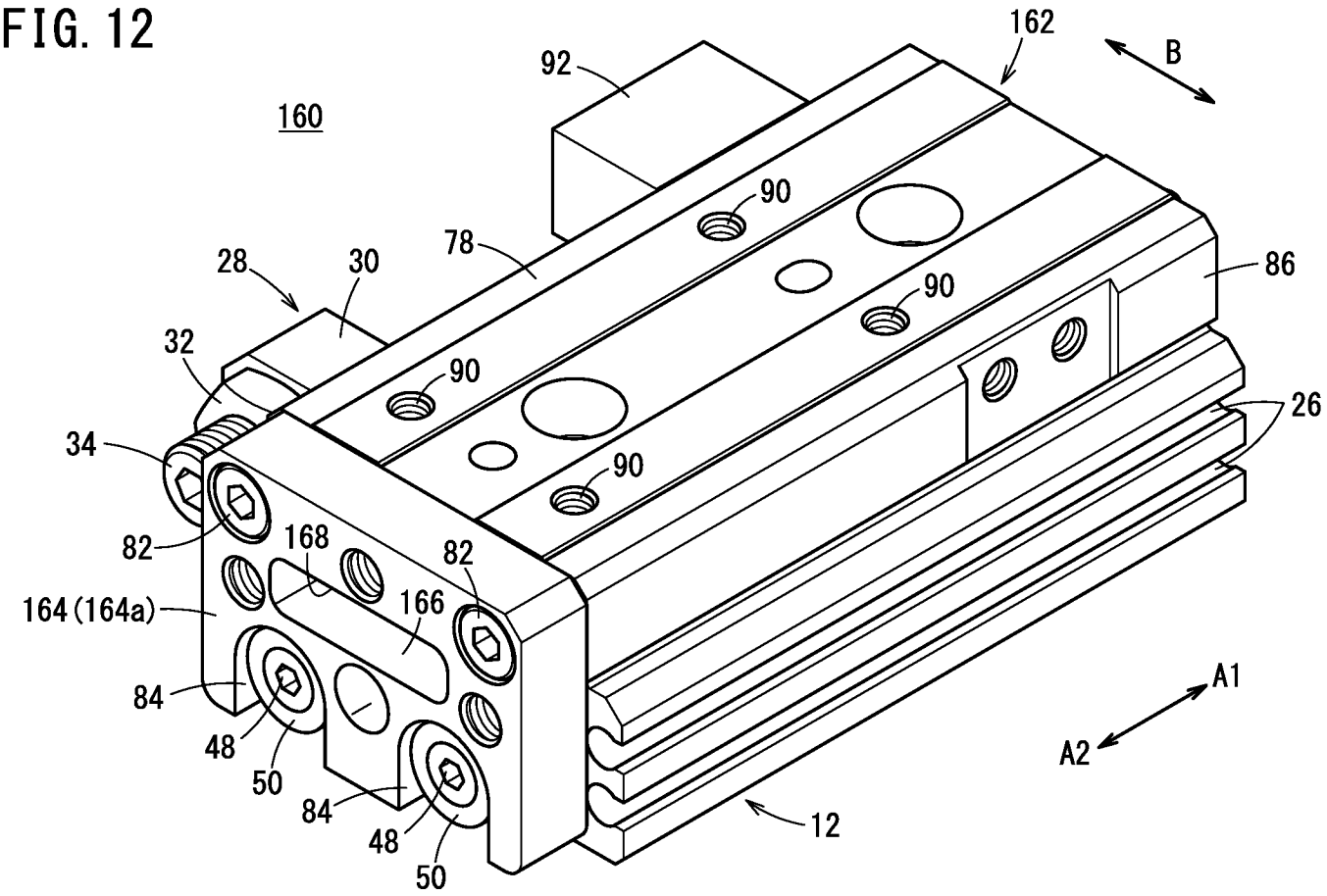
FIG. 12 is an external perspective view of a linear actuator according to a third embodiment of the present invention.
Figure 13:
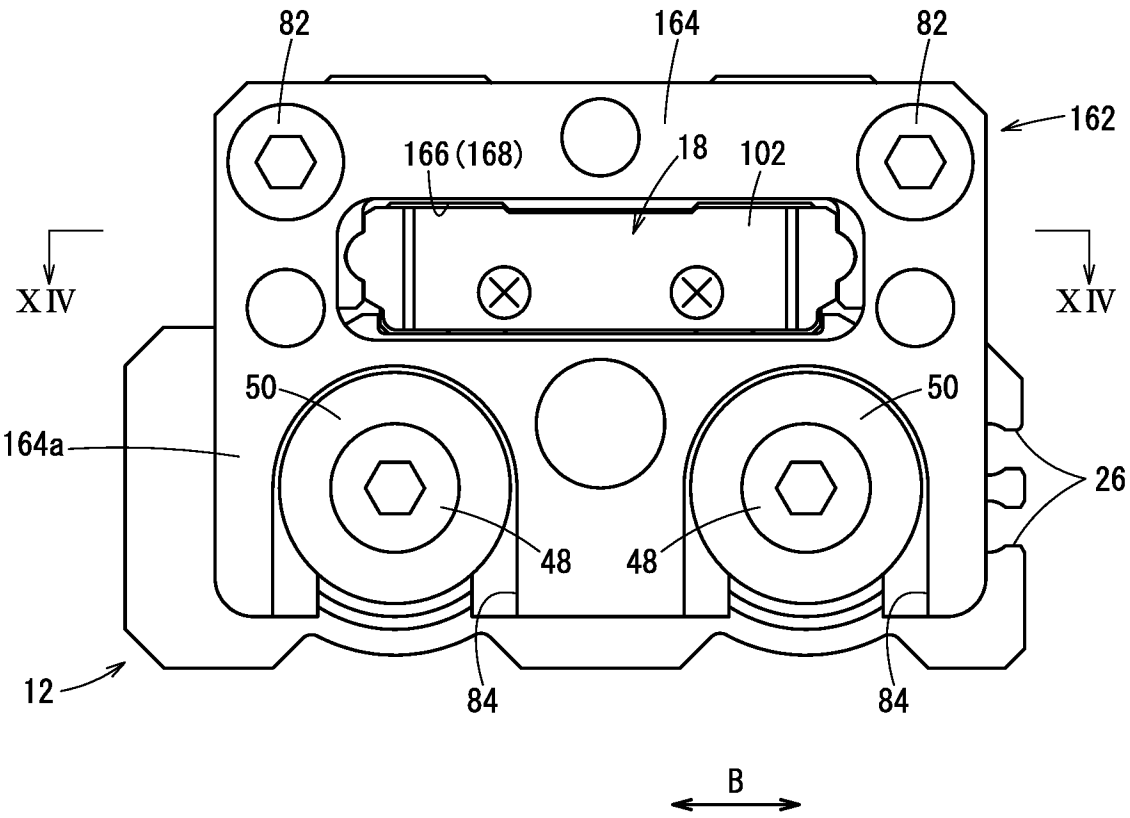
FIG. 13 is a front view of the linear actuator shown in FIG. 12 as viewed from the end plate side.
Figure 14:
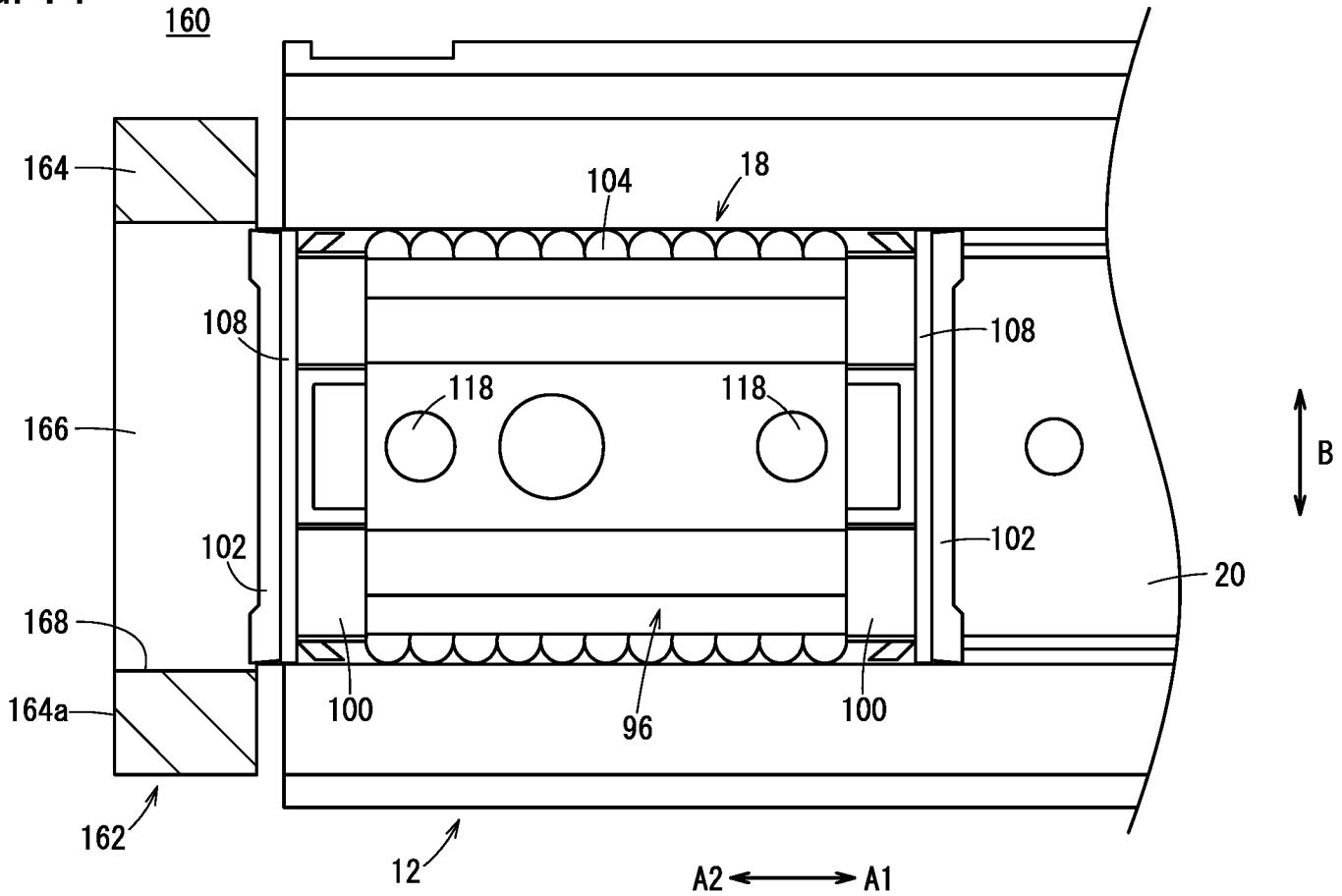
FIG. 14 is a partial sectional plan view taken along a XIV-XIV line in FIG. 13.

As shown in FIGS. 12 to 14, the linear actuator 160 includes the storage chamber 166 in the end plate 164 constituting the slide table 162. The storage chamber 166, which has, for example, a constant cross-sectional shape, is formed so as to penetrate through the end plate 164 in the thickness direction of the end plate, i.e., in the longitudinal direction of the slide table 162 (the direction of arrows A1 and A2). That is, the storage chamber 166 is opened on the end surface 164*a* of the end plate 164 at the second longitudinal end side.

In this configuration, when the linear actuator 160 described above is used in an environment where powder dust and the like is scattered, and a solidified matter formed of a mixture of the powder dust and the like and the lubricant is stored in the storage chamber 166, for example, an unillustrated operator can readily and surely take out the solidified matter from the opened portion (opening), designated at 168, of the storage chamber 166, which is open toward the second longitudinal end side (the direction of arrow A2). Accordingly, it is no longer necessary to remove or move the slide table 162, thus making it possible to improve the maintainability.

Further, since the storage chamber 166 is opened on the end surface 164*a* of the end plate 164 at the second longitudinal end side, the solidified matter is gradually pushed toward the storage chamber 166 from the guide mechanism 18 side and accumulated therein, and then the solidified matter is pushed out from the opened portion 168 and discharged from the end plate 164. That is, since work for removing the solidified matter in the storage chamber 166 is not required, the maintainability can be further improved.

Figure 15:
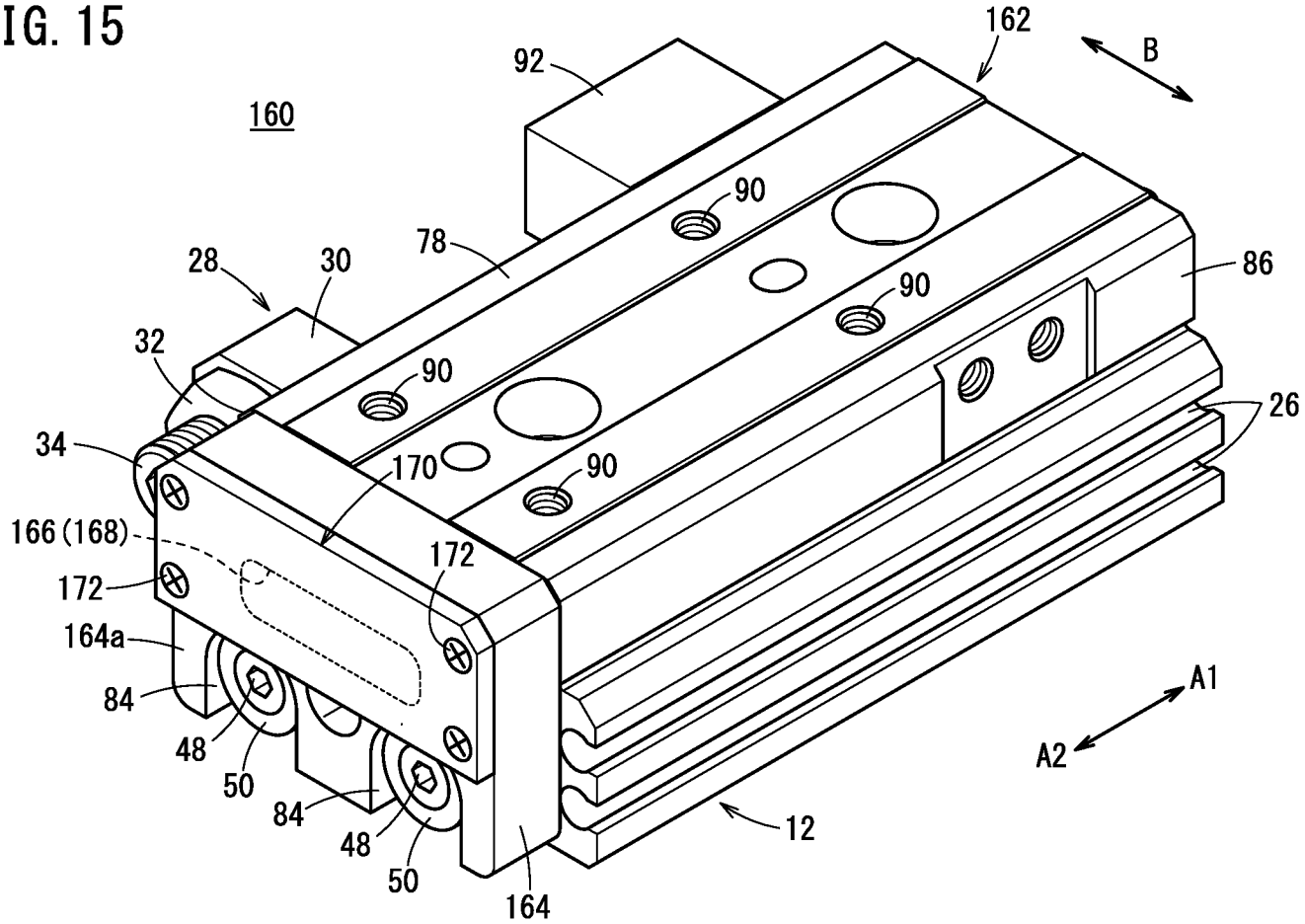
FIG. 15 is an external perspective view showing the case where a cover member is attached to the end plate of the linear actuator of FIG. 12.
Figure 16:
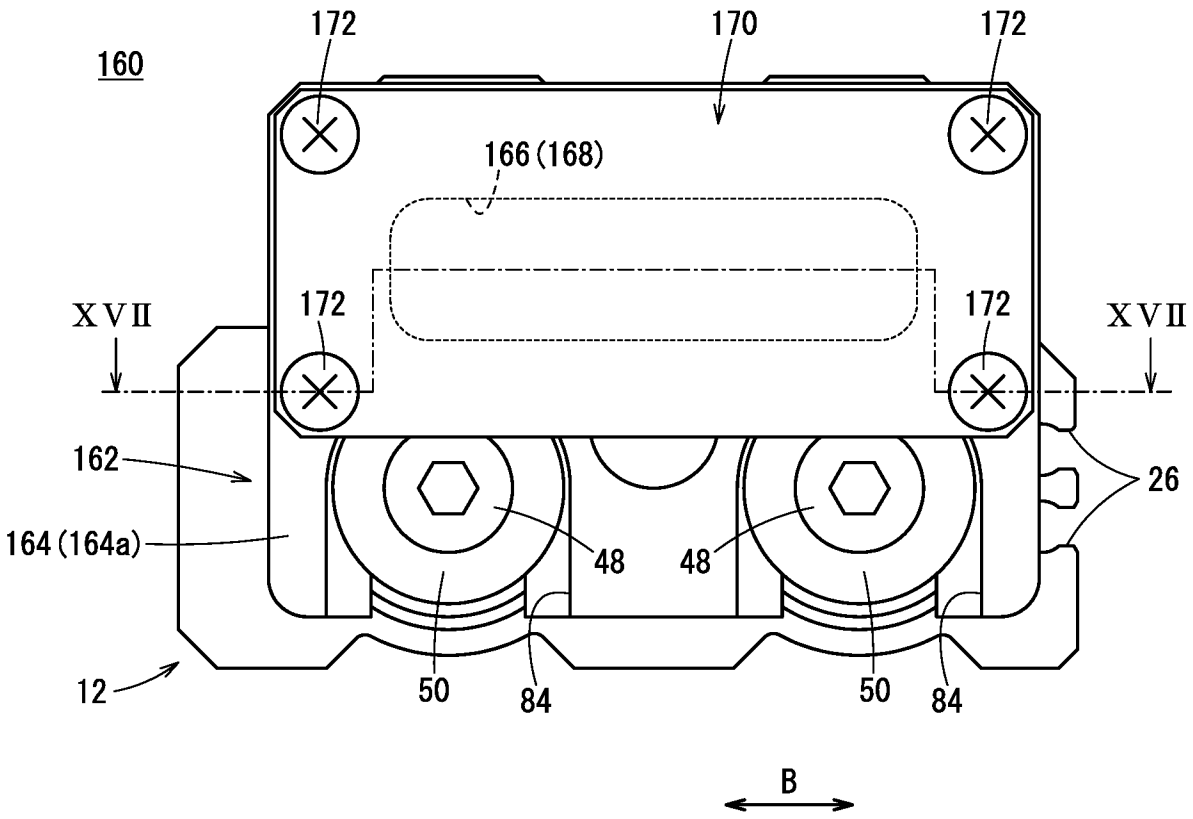
FIG. 16 is a front view of the linear actuator shown in FIG. 15 as viewed from the end plate side.
Figure 17:
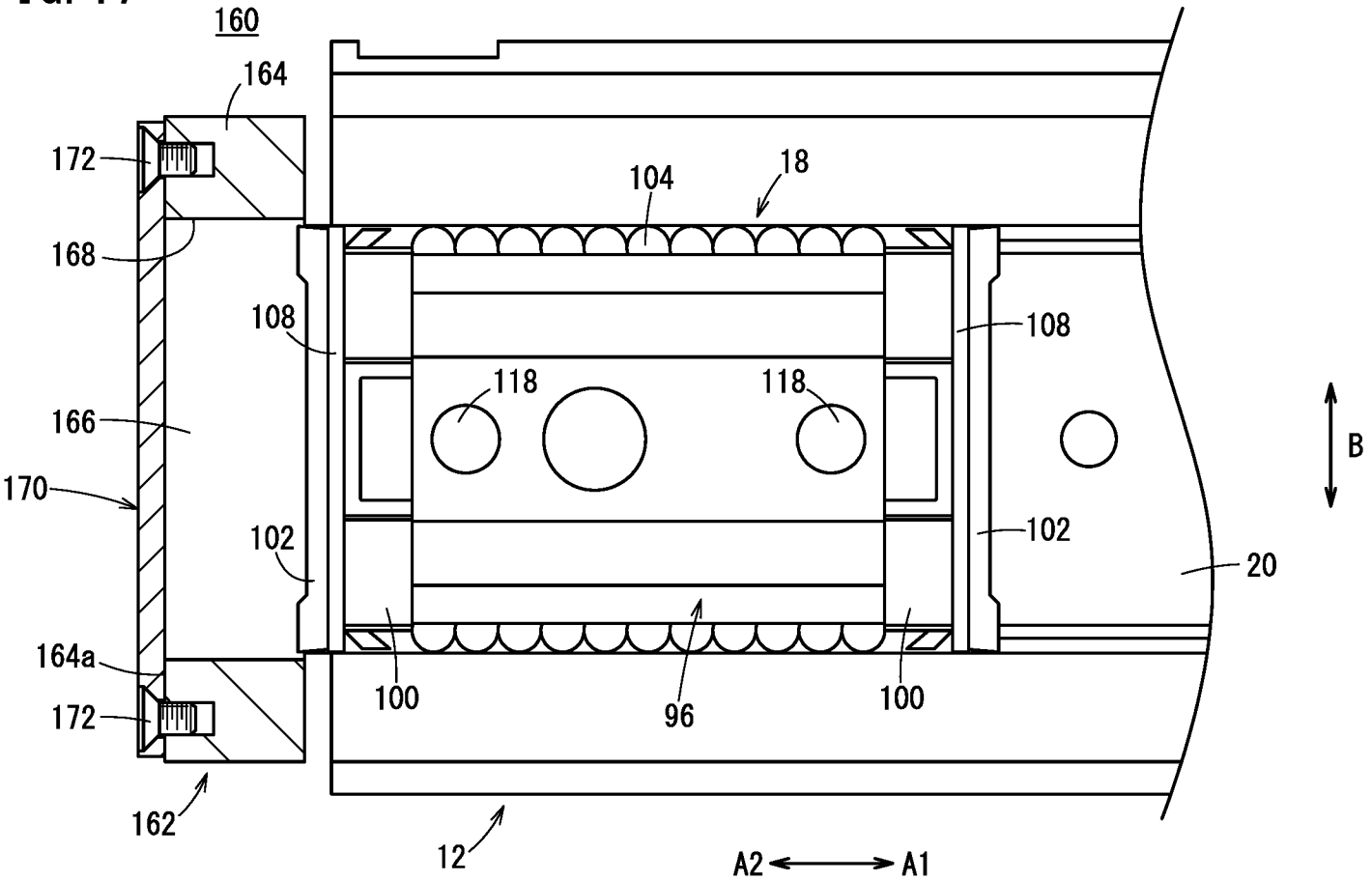
FIG. 17 is a partial sectional plan view taken along a line XVII-XVII of FIG. 16.
Figure 18:
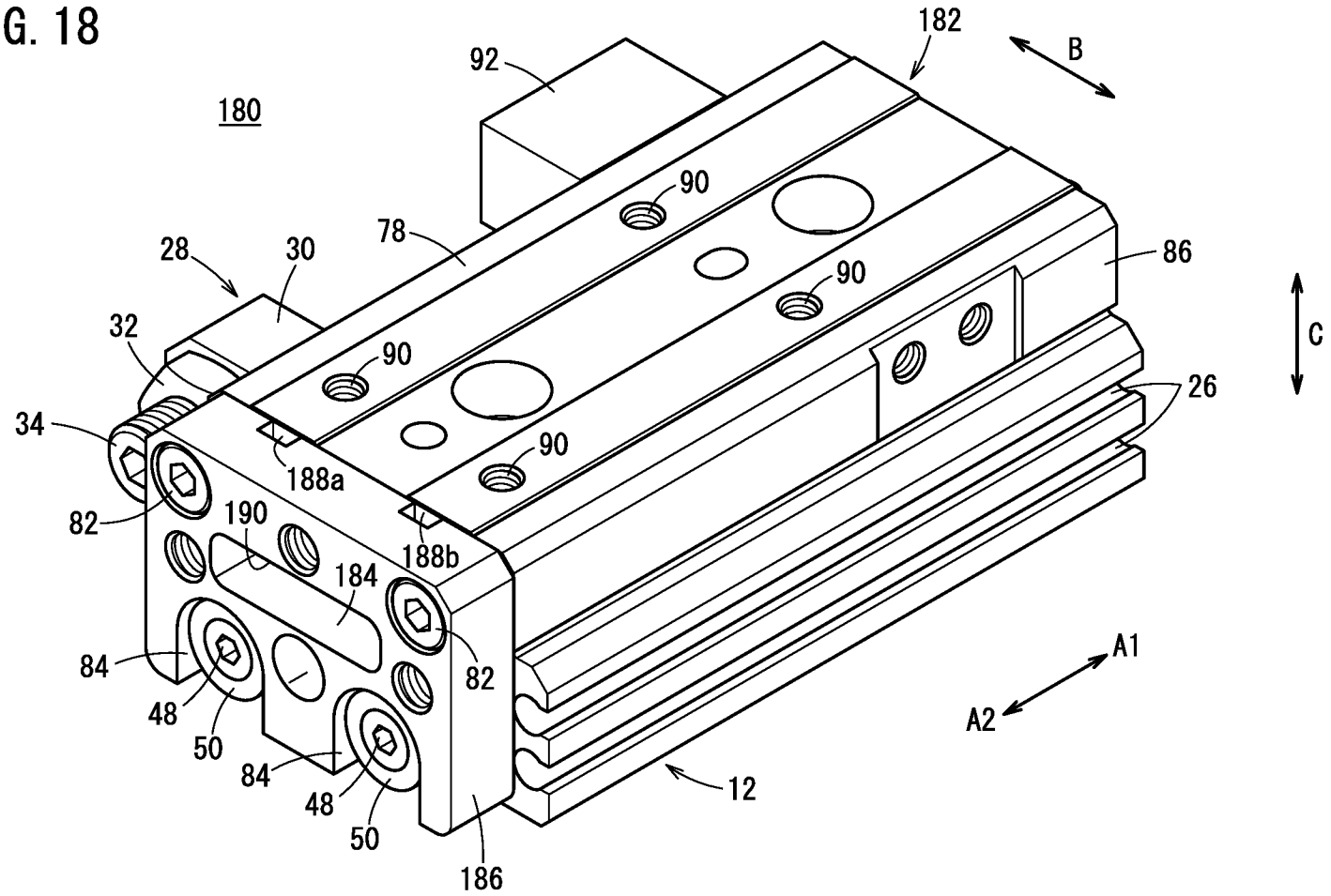
FIG. 18 is an external perspective view of a linear actuator according to a fourth embodiment of the present invention.
Figure 19:
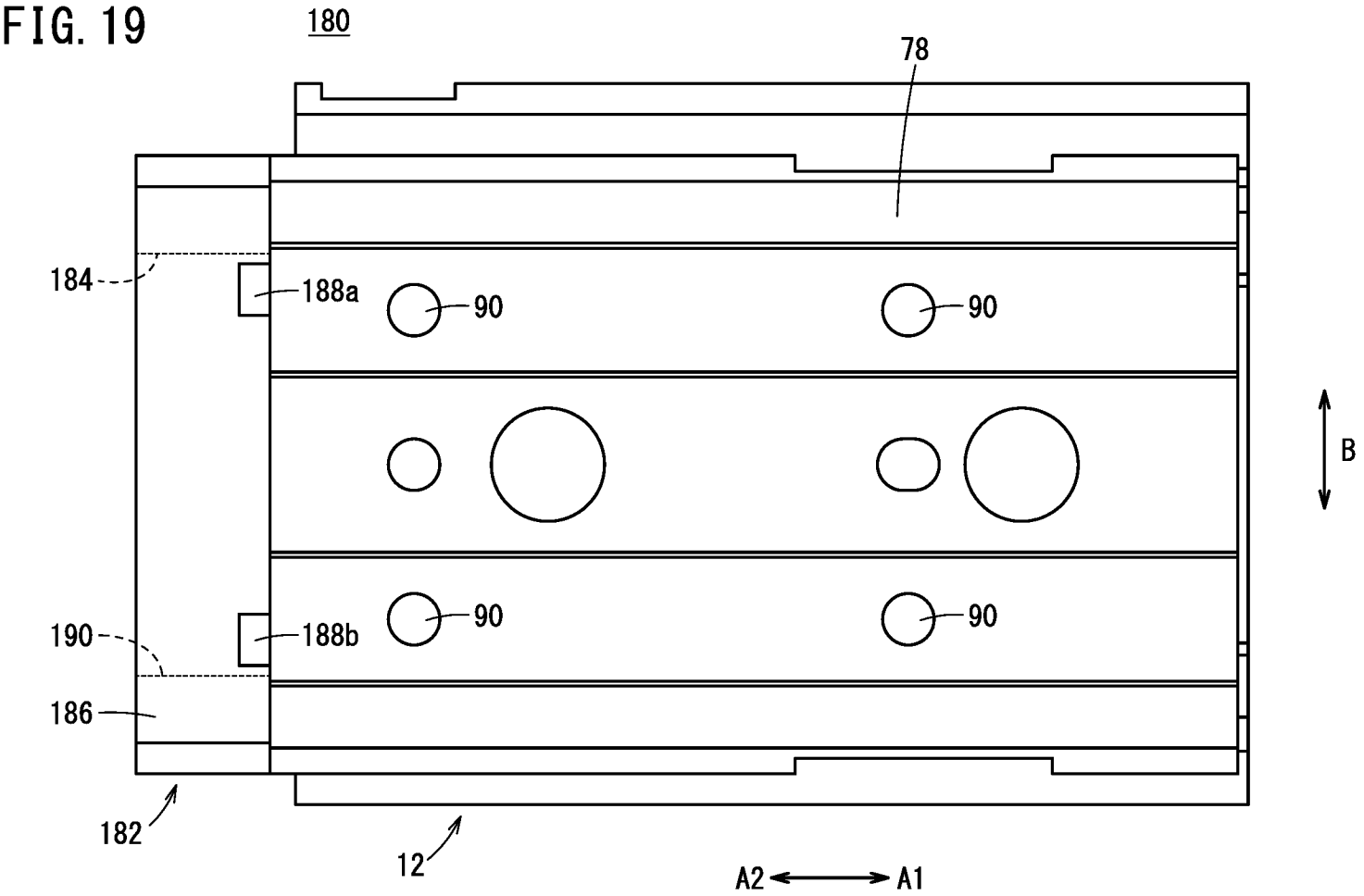
FIG. 19 is an overall plan view of the linear actuator shown in FIG. 18.
Figure 20:
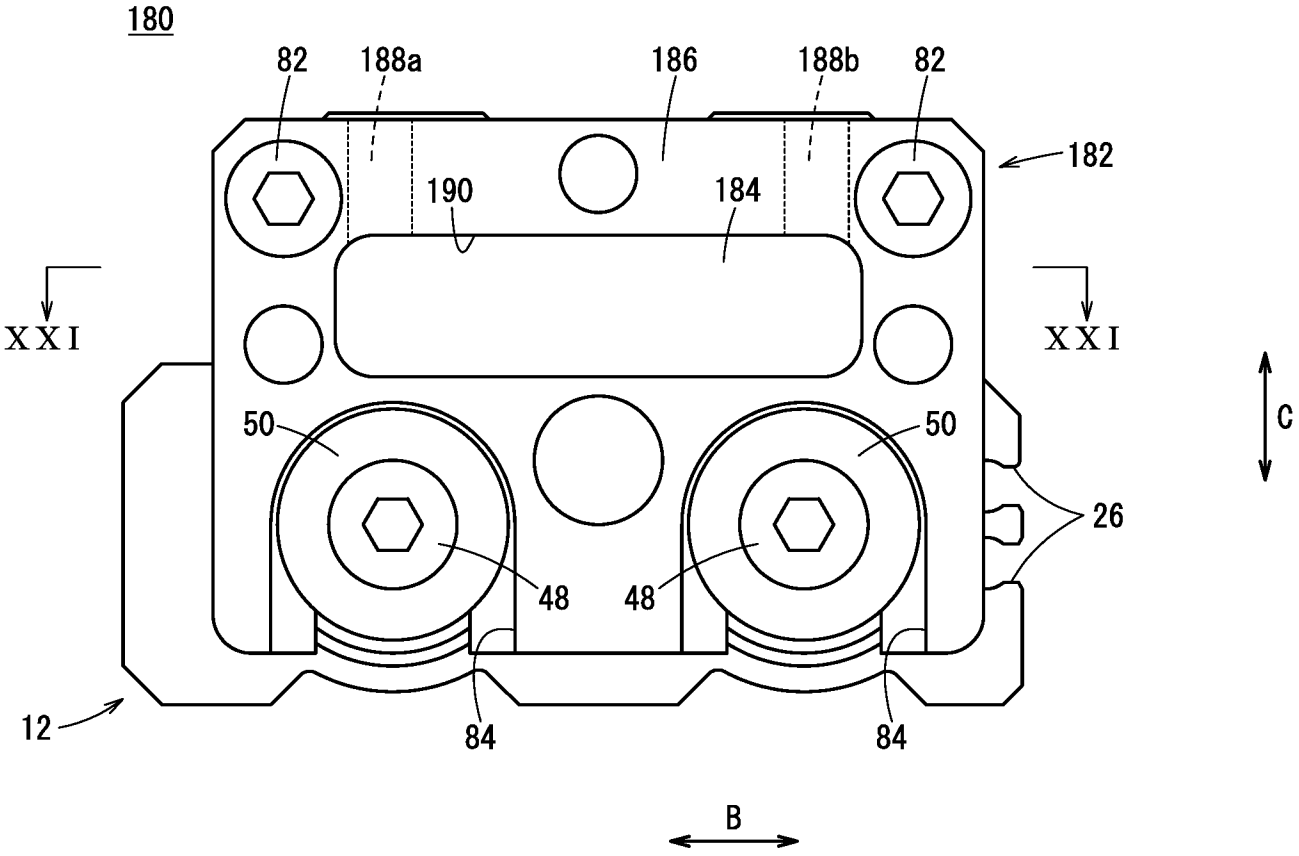
FIG. 20 is a front view of the linear actuator shown in FIG. 18 as viewed from the end plate side.
Figure 21:
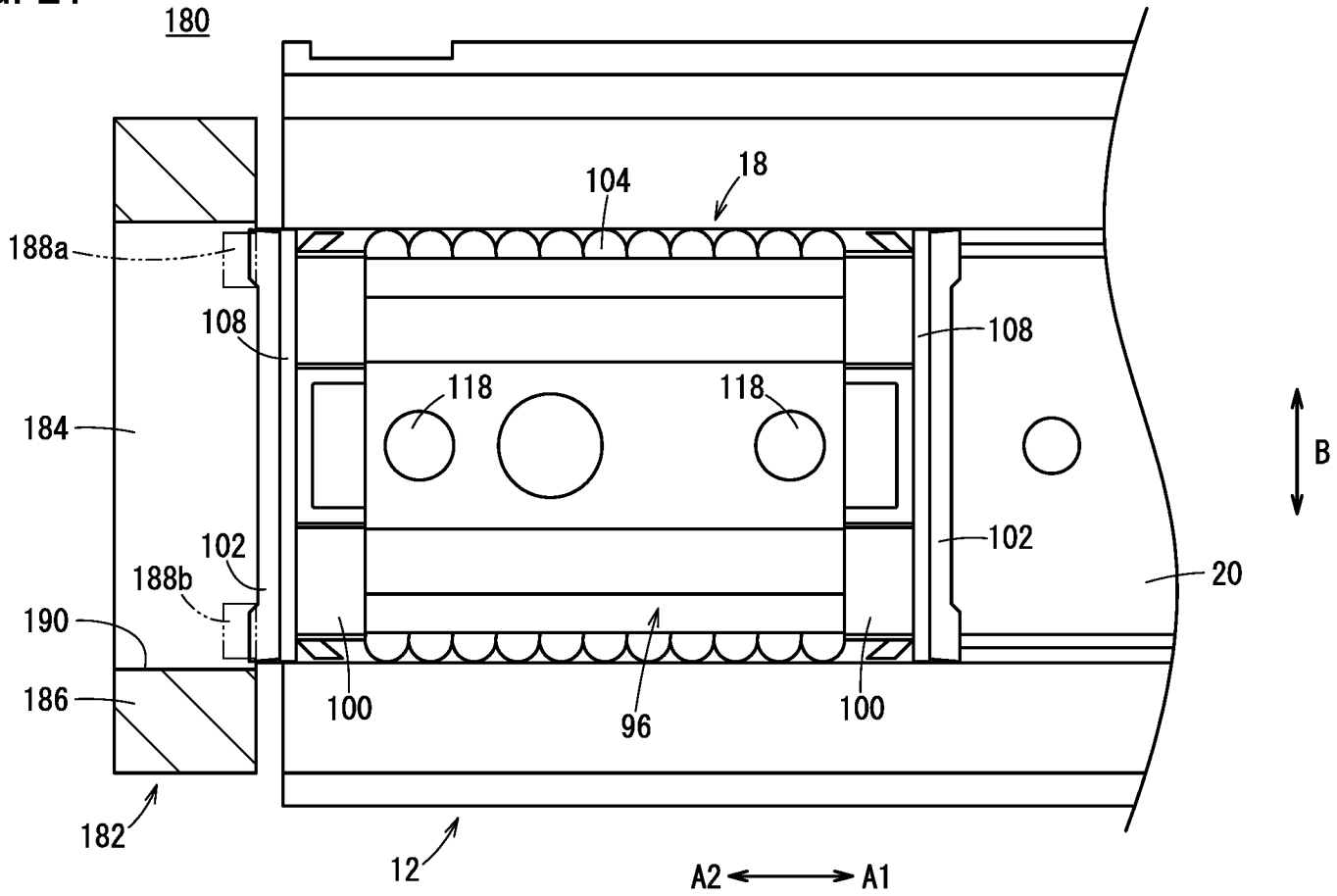
FIG. 21 is a partial sectional plan view taken along a XXI-XXI line of FIG. 20.

Further, as shown in FIGS. 15 to 17, a cover member 170 for covering the opened portion 168 of the storage chamber 166 may be provided on the end surface 164*a* on the second longitudinal end side of the end plate 164. The cover member 170 is formed into a plate shape larger than the cross-sectional area of the opening of the storage chamber 166, for example, and is fastened, at four corners thereof, to the end surface 164*a* on the second longitudinal end side with cover fixing bolts 172, to cover the opened portion 168 of the storage chamber 166. That is, the cover member 170 is detachably attached to the end plate 164.

In the thus configured linear actuator 160, by setting the cover member 170 to the end plate 164 in a normal use state, it is possible to prevent powder dust and the like from entering the inside through the opened portion 168 of the storage chamber 166. On the other hand, when the solidified matter accumulated in the storage chamber 166 is removed, the cover fixing bolts 172 are unfastened so as to detach the cover member 170 from the end plate 164 and remove the solidified matter from the opened storage chamber 166. After completion of the work, the cover member 170 is attached again to cover the opened portion.

Finally, FIGS. 18 to 21 show a linear actuator 180 according to the fourth embodiment. The same components as those of the linear actuator 160 according to the third embodiment described above are allotted with the same reference numerals, and detailed description thereof will be omitted.

The linear actuator 180 according to the fourth embodiment differs from the linear actuator 160 according to the third embodiment in that, in the slide table 102, a storage chamber (storage portion) 184 penetrating in the thickness direction (the direction of arrows A1 and A2) is provided, and an end plate 186 has a pair of work holes 188*a* and 188*b*.

As shown in FIGS. 18 to 21, the linear actuator 180 includes the storage chamber 184 formed in the end plate 186 of the slide table 182. The storage chamber 184 penetrates through the end plate 186 in the thickness direction of the end plate, i.e., in the longitudinal direction of the slide table 182 (the direction of arrows A1 and A2) so as to have a constant cross section. Further, the end plate 186 is formed with a pair of work holes 188*a* and 188*b* extending in the height direction (in the direction of arrow C) from the upper surface thereof toward the storage chamber 184 to communicate with the storage chamber 184.

When the thus configured linear actuator 180 is used in an environment in which powder dust and the like are scattered, and a solidified matter generated by mixing the powder dust and the like with lubricant is stored in the storage chamber 184, for example, an unillustrated operator can easily and surely take out the solidified matter from an opened portion 190 of the storage chamber 184 which is opened toward the second longitudinal end side (to the direction of arrow A2). Further, by supplying a compressed air to the storage chamber 184 through the work holes 188*a* and 188*b*, the solidified matter accumulated inside the storage chamber 184 can be more smoothly discharged from the front to the outside.

As a result, the solidified matter in the storage chamber 184 can be removed through the opened portion 190, and also by using a compressed air supplied from the work holes 188*a* and 188*b*, the maintainability for removing the solidified matter can be greatly improved.

Figure 22:
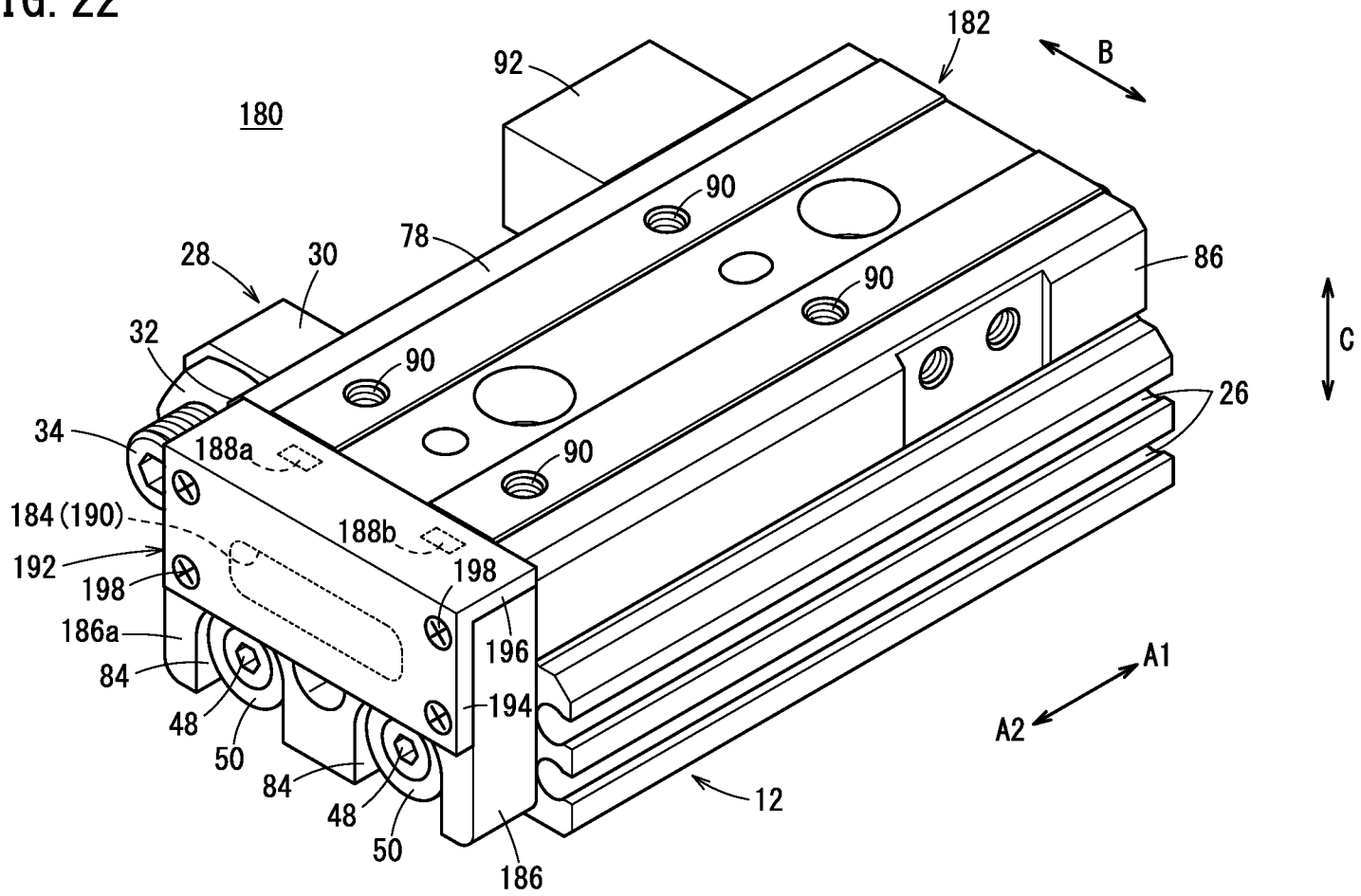
FIG. 22 is an external perspective view showing the case where a cover member is attached to the end plate of the linear actuator of FIG. 18.
Figure 23A:
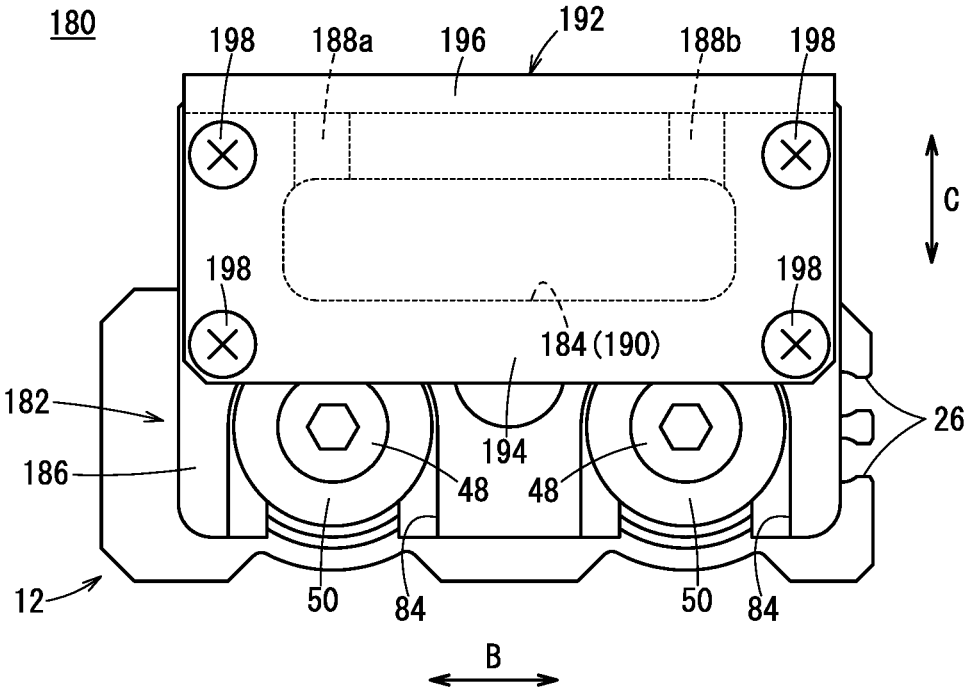
FIG. 23A is a front view of the linear actuator shown in FIG. 22 as viewed from the end plate side.
Figure 23B:
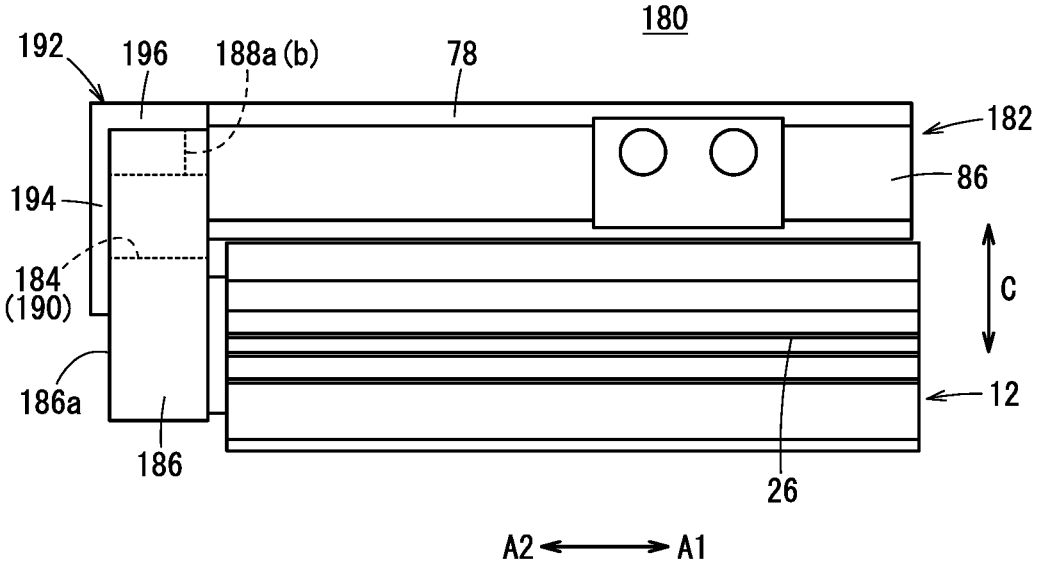
FIG. 23B is an enlarged side view of the linear actuator of FIG. 23A as viewed from the side.

Further, as shown in FIGS. 22 to 23B, a cover member 192 for covering the opened portion 190 of the storage chamber 184 and the work holes 188*a*, 188*b* all together may be provided on the end plate 186.

The cover member 192 is, for example, formed of a first lid portion 194 that covers the opened portion 190 of the storage chamber 184 and a second lid portion 196 extending from the upper end of the first lid portion 194 perpendicularly to the first lid portion 194, so as to form an L-shaped cross section as a whole. The cover member 192 is attached to the end plate 186 by fastening the four corners of the first lid portion 194 to an end surface 186*a* of the end plate 186 on the second longitudinal end side with cover fixing bolts 198, whereby the first lid portion 194 covers the opened portion 190 of the storage chamber 184 while the second lid portion 196 abuts the top surface of the end plate 186 to cover the paired work holes 188*a* and 188*b*.

Thus, in this linear actuator 180, by setting the cover member 192 to the end plate 186 in a normal use state, it is possible to prevent powder dust and the like from entering the inside through the opened portion 190 of the storage chamber 184, as well as through the work holes 188*a* and 188*b*.

On the other hand, when the solidified matter accumulated in the storage chamber 184 is removed, the cover fixing bolts 198 are unfastened to thereby detach the cover member 192 and the solidified matter is then removed through the opened portion 190 of the storage chamber 184. After completion of the work, the cover member 192 is set again to cover them, so that it is possible to suitably prevent powder dust and the like from entering the linear actuator through the opened portion 190 of the storage chamber 184 and the work holes 188*a* and 188*b*.

It should be noted that the linear actuator according to the present invention is not limited to the above-described embodiments, and of course, various configurations can be adopted without departing from the gist of the present invention.

What is claimed is:

1. A linear actuator, comprising:

a cylinder body containing therein a cylinder chamber to which a pressure fluid is supplied;

a slide table configured to be movable along a longitudinal direction of the cylinder body;

a cylinder mechanism having a piston arranged in the cylinder chamber and configured to be movable along the cylinder chamber; and a guide mechanism attached to the cylinder body and configured to guide the slide table along the longitudinal direction of the cylinder body under rolling action of a plurality of rolling elements circulating a passage, the linear actuator being configured to reciprocate the slide table relative to the cylinder body under moving action of the piston, wherein:

the slide table includes a main body extending in the longitudinal direction of the cylinder body, and an end part arranged substantially orthogonal to the main body so as to face an end portion of the cylinder body in the longitudinal direction;

the end part is configured to have a storage portion that is opened on an end surface, of the end part, that faces the cylinder body, the storage portion extending in the longitudinal direction, the storage portion being configured to store dust and dirt therein;

the storage portion is formed so as to penetrate through the end part in the longitudinal direction; and the end part has a work hole extending in a direction substantially orthogonal to an extending direction of the storage portion, the work hole being configured to establish communication between the storage portion and outside.

2. The linear actuator according to claim 1, wherein the storage portion is formed at a position facing the guide mechanism when viewed from the longitudinal direction.

3. The linear actuator according to claim 1, further comprising a cover member configured to cover an opening of the storage portion, the cover member being detachably attached to the end part.

4. A linear actuator comprising:

a cylinder body containing therein a cylinder chamber to which a pressure fluid is supplied;

a slide table configured to be movable along a longitudinal direction of the cylinder body;

a cylinder mechanism having a piston arranged in the cylinder chamber and configured to be movable along the cylinder chamber; and a guide mechanism attached to the cylinder body and configured to guide the slide table along the longitudinal direction of the cylinder body under rolling action of a plurality of rolling elements circulating a passage, the linear actuator being configured to reciprocate the slide table relative to the cylinder body under moving action of the piston, wherein:

the slide table includes a main body extending in the longitudinal direction of the cylinder body, and an end part arranged substantially orthogonal to the main body so as to face an end portion of the cylinder body in the longitudinal direction;

the end part is configured to have a storage portion that is opened on an end surface, of the end part, that faces the cylinder body, the storage portion extending in the longitudinal direction, the storage portion being configured to store dust and dirt therein;

the storage portion is formed so as not to penetrate through the end part in the longitudinal direction, and the end part has a work hole extending in a direction substantially orthogonal to an extending direction of the storage portion, the work hole being configured to establish communication between the storage portion and outside.

* * * * *